US007874731B2

(12) United States Patent
Turvey et al.

(10) Patent No.: US 7,874,731 B2
(45) Date of Patent: Jan. 25, 2011

(54) VALVE FOR A RECLOSEABLE CONTAINER

(75) Inventors: Robert R. Turvey, Sanford, MI (US); Brian C. Dais, Saginaw, MI (US); Bryan L. Ackerman, Freeland, MI (US); James C. Pawloski, Bay City, MI (US); Daniel P. Zimmerman, Livonia, MI (US); Amanda A. Jones, Michigan Center, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 893 days.

(21) Appl. No.: 11/818,591

(22) Filed: Jun. 15, 2007

(65) Prior Publication Data

US 2008/0310770 A1 Dec. 18, 2008

(51) Int. Cl.
*B65D 33/01* (2006.01)
*B65D 33/16* (2006.01)

(52) U.S. Cl. ..... 383/103; 383/63

(58) Field of Classification Search ..... 383/100–103, 383/63

See application file for complete search history.

(56) References Cited

U.S. PATENT DOCUMENTS

| | | | |
|---|---|---|---|
| 2,576,322 | A | 11/1951 | Waters |
| 2,593,328 | A | 4/1952 | Meaker |
| 2,609,314 | A | 9/1952 | Engel et al. |
| 2,633,442 | A | 3/1953 | Caldwell |
| 2,642,372 | A | 6/1953 | Chittick |
| 2,670,501 | A | 3/1954 | Michiels |
| 2,759,866 | A | 8/1956 | Seymour |
| 2,772,712 | A | 12/1956 | Post |
| 2,776,452 | A | 1/1957 | Chavannes |
| 2,778,171 | A | 1/1957 | Taunton |
| 2,778,173 | A | 1/1957 | Taunton |
| 2,821,338 | A | 1/1958 | Metzger |
| 2,856,323 | A | 10/1958 | Gordon |
| 2,858,247 | A | 10/1958 | De Swart |
| 2,870,954 | A | 1/1959 | Kulesza |
| 2,913,030 | A | 11/1959 | Fisher |
| 2,916,411 | A | 12/1959 | Villoresi |
| 2,927,722 | A | 3/1960 | Metzger |
| 2,960,144 | A | 11/1960 | Graf |

(Continued)

FOREIGN PATENT DOCUMENTS

| | | |
|---|---|---|
| CA | 1315746 | 4/1993 |

(Continued)

*Primary Examiner*—Jes F Pascua

(57) ABSTRACT

A valve for a reclosable container comprises first and second opposing layers of a film material, wherein an overlap region of the second layer overlaps the container, and the first layer is sealed to the second layer around a portion of the second layer. The second layer is sealed to the container around a periphery of the overlap region, and opposing surfaces of the first and second layers form a substantially airtight seal therebetween upon direct contact of the layers. First and second offset apertures extend through the first and second layers, respectively. One of the first and second apertures is in fluid communication with an interior of the container and the other of the first and second apertures is in fluid communication with an exterior of the container. Vacuum pressure disposed over both of the first and second apertures causes the first layer to separate from the second layer to allow air to exhaust from the container.

20 Claims, 13 Drawing Sheets

U.S. PATENT DOCUMENTS

| | | | |
|---|---|---|---|
| 3,026,231 | A | 3/1962 | Chavannes |
| 3,060,985 | A | 10/1962 | Vance et al. |
| 3,077,428 | A | 2/1963 | Heuser et al. |
| 3,098,563 | A | 7/1963 | Skees |
| 3,102,676 | A | 9/1963 | Danelli et al. |
| 3,113,715 | A | 12/1963 | Pangrac |
| 3,141,221 | A | 7/1964 | Faulls, Jr. |
| 3,142,599 | A | 7/1964 | Chavannes |
| 3,149,772 | A | 9/1964 | Olsson |
| 3,160,323 | A | 12/1964 | Weisberg |
| 3,216,172 | A | 11/1965 | Piazze |
| 3,219,084 | A | 11/1965 | Ausnit et al. |
| 3,224,574 | A | 12/1965 | McConnell |
| 3,237,844 | A | 3/1966 | Hughes |
| 3,251,463 | A | 5/1966 | Bodet |
| 3,302,859 | A | 2/1967 | Perry |
| 3,325,084 | A | 6/1967 | Ausnit |
| 3,372,442 | A | 3/1968 | Ishimatsu |
| 3,381,887 | A | 5/1968 | Lowry |
| 3,389,733 | A | 6/1968 | Siegel |
| 3,411,698 | A | 11/1968 | Reynolds |
| 3,423,231 | A | 1/1969 | Lutzmann |
| 3,440,696 | A | 4/1969 | Staller |
| 3,464,094 | A | 9/1969 | Mates |
| 3,516,217 | A | 6/1970 | Gildersleeve |
| 3,557,413 | A | 1/1971 | Engle |
| 3,565,147 | A | 2/1971 | Ausnit |
| 3,575,781 | A | 4/1971 | Pezely |
| 3,595,467 | A | 7/1971 | Goglio |
| 3,595,722 | A | 7/1971 | Dawbarn |
| 3,595,740 | A | 7/1971 | Gerow |
| 3,600,267 | A | 8/1971 | McFedries, Jr. et al. |
| 3,608,439 | A | 9/1971 | Ausnit |
| 3,628,720 | A | 12/1971 | Schmedding |
| 3,633,642 | A | 1/1972 | Siegel |
| 3,655,501 | A | 4/1972 | Tesch |
| 3,661,677 | A | 5/1972 | Wang |
| 3,679,511 | A | 7/1972 | Ausnit |
| 3,746,215 | A | 7/1973 | Ausnit et al. |
| 3,762,404 | A | 10/1973 | Sakita |
| 3,780,781 | A | 12/1973 | Uramoto |
| 3,790,992 | A | 2/1974 | Herz |
| 3,799,427 | A | 3/1974 | Goglio |
| 3,809,217 | A | 5/1974 | Harrison |
| 3,828,520 | A | 8/1974 | Merritt |
| 3,833,166 | A | 9/1974 | Murray |
| 3,908,070 | A | 9/1975 | Marzolf |
| 3,918,131 | A | 11/1975 | Ausnit |
| 3,937,396 | A | 2/1976 | Schneider |
| 3,980,226 | A | 9/1976 | Franz |
| 3,989,182 | A | 11/1976 | Stearley |
| 4,000,846 | A | 1/1977 | Gilbert |
| 4,020,884 | A | 5/1977 | Jadot |
| RE29,524 | E | 1/1978 | Spencer |
| 4,085,886 | A | 4/1978 | Nishioka |
| 4,101,355 | A | 7/1978 | Ausnit |
| 4,104,404 | A | 8/1978 | Bieler et al. |
| 4,105,491 | A | 8/1978 | Haase et al. |
| 4,122,993 | A | 10/1978 | Glas |
| 4,134,535 | A | 1/1979 | Barthels et al. |
| 4,155,453 | A | 5/1979 | Ono |
| 4,186,786 | A | 2/1980 | Kirkpatrick |
| 4,206,870 | A | 6/1980 | DeVries |
| 4,212,337 | A | 7/1980 | Kamp |
| 4,215,725 | A | 8/1980 | Callet et al. |
| 4,246,288 | A | 1/1981 | Sanborn, Jr. |
| 4,267,960 | A | 5/1981 | Lind et al. |
| 4,310,118 | A | 1/1982 | Kisida et al. |
| 4,332,344 | A | 6/1982 | Strodthoff |
| 4,337,804 | A | 7/1982 | Maruscak |
| 4,340,558 | A | 7/1982 | Hendrickson |
| 4,354,541 | A | 10/1982 | Tilman |
| 4,355,494 | A | 10/1982 | Tilman |
| 4,363,345 | A | 12/1982 | Scheibner |
| 4,364,989 | A | 12/1982 | Moyle |
| 4,370,187 | A | 1/1983 | Katagiri et al. |
| 4,372,921 | A | 2/1983 | Sanderson et al. |
| 4,426,816 | A | 1/1984 | Dean et al. |
| 4,430,070 | A | 2/1984 | Ausnit |
| 4,449,243 | A | 5/1984 | Platel |
| 4,470,153 | A | 9/1984 | Kenan |
| 4,491,959 | A | 1/1985 | Loefberg |
| 4,509,642 | A | 4/1985 | Rowell |
| 4,524,460 | A | 6/1985 | Twiehoff et al. |
| 4,528,224 | A | 7/1985 | Ausnit |
| 4,532,652 | A | 7/1985 | Herrington |
| 4,541,117 | A | 9/1985 | Ashbeck |
| 4,550,546 | A | 11/1985 | Raley et al. |
| 4,551,379 | A | 11/1985 | Kerr |
| 4,566,131 | A | 1/1986 | Achelpohl |
| 4,569,712 | A | 2/1986 | Shibano et al. |
| 4,576,283 | A | 3/1986 | Fafournoux |
| 4,576,285 | A | 3/1986 | Goglio |
| 4,578,813 | A | 3/1986 | Ausnit |
| 4,579,784 | A | 4/1986 | Lemstra et al. |
| 4,581,764 | A | 4/1986 | Plock et al. |
| 4,612,221 | A | 9/1986 | Biel et al. |
| 4,653,661 | A | 3/1987 | Buchner et al. |
| 4,658,433 | A | 4/1987 | Savicki |
| 4,658,434 | A | 4/1987 | Murray |
| 4,660,355 | A | 4/1987 | Kristen |
| 4,672,684 | A | 6/1987 | Barnes et al. |
| 4,683,702 | A | 8/1987 | Vis |
| 4,691,372 | A | 9/1987 | Van Erden |
| 4,691,373 | A | 9/1987 | Ausnit |
| 4,701,358 | A | 10/1987 | Behr et al. |
| 4,702,376 | A | 10/1987 | Pagliaro |
| 4,705,174 | A | 11/1987 | Goglio |
| 4,712,574 | A | 12/1987 | Perrott |
| 4,715,494 | A | 12/1987 | Heitzenröder et al. |
| 4,730,635 | A | 3/1988 | Linden |
| 4,731,911 | A | 3/1988 | Gould |
| 4,736,450 | A | 4/1988 | Van Erden et al. |
| 4,736,451 | A | 4/1988 | Ausnit |
| 4,747,702 | A | 5/1988 | Scheibner |
| 4,752,992 | A | 6/1988 | Kondo et al. |
| 4,756,422 | A | 7/1988 | Kristen |
| 4,756,628 | A | 7/1988 | Branson |
| 4,756,629 | A | 7/1988 | Tilman et al. |
| 4,778,282 | A | 10/1988 | Borchardt et al. |
| 4,780,937 | A | 11/1988 | Kusayama |
| 4,782,951 | A | 11/1988 | Griesbach et al. |
| 4,784,885 | A | 11/1988 | Carespodi |
| 4,787,754 | A | 11/1988 | Herrington |
| 4,787,755 | A | 11/1988 | Branson |
| 4,787,880 | A | 11/1988 | Ausnit |
| 4,791,710 | A | 12/1988 | Nocek et al. |
| 4,792,240 | A | 12/1988 | Ausnit |
| 4,795,269 | A | 1/1989 | Scheibner |
| 4,796,300 | A | 1/1989 | Branson |
| 4,807,300 | A | 2/1989 | Ausnit et al. |
| 4,808,010 | A | 2/1989 | Vogan |
| 4,812,056 | A | 3/1989 | Zieke |
| 4,812,074 | A | 3/1989 | Ausnit et al. |
| 4,817,188 | A | 3/1989 | Van Erden |
| 4,825,514 | A | 5/1989 | Akeno |
| 4,829,641 | A | 5/1989 | Williams |
| 4,832,505 | A | 5/1989 | Ausnit et al. |
| 4,834,554 | A | 5/1989 | Stetler, Jr. et al. |
| 4,840,611 | A | 6/1989 | Van Erden et al. |
| 4,841,603 | A | 6/1989 | Ragni |
| 4,854,733 | A | 8/1989 | Schwinn |
| 4,858,286 | A | 8/1989 | Siegel |
| 4,859,259 | A | 8/1989 | Scheibner |

4,861,632 A 8/1989 Caggiano
4,863,286 A 9/1989 Branson
4,869,725 A 9/1989 Schneider et al.
4,875,259 A 10/1989 Appeldorn
4,877,334 A 10/1989 Cope
4,877,336 A 10/1989 Peppiatt
4,878,763 A 11/1989 Ausnit
4,890,637 A 1/1990 Lamparter
4,890,935 A 1/1990 Ausnit et al.
4,892,414 A 1/1990 Ausnit
4,898,477 A 2/1990 Cox et al.
4,903,718 A 2/1990 Sullivan
4,907,321 A 3/1990 Williams
4,909,017 A 3/1990 McMahon et al.
4,911,960 A 3/1990 Mudge et al.
4,923,701 A 5/1990 VanErden
4,925,318 A 5/1990 Sorenson
4,928,829 A 5/1990 Di Bernardo
4,929,487 A 5/1990 Tilman et al.
4,930,904 A 6/1990 Gröner et al.
4,937,139 A 6/1990 Genske et al.
4,941,307 A 7/1990 Wojcik
4,941,310 A 7/1990 Kristen
4,947,525 A 8/1990 Van Erden
4,953,708 A 9/1990 Beer et al.
4,961,944 A 10/1990 Matoba et al.
4,964,739 A 10/1990 Branson et al.
4,965,108 A 10/1990 Biel et al.
4,966,470 A 10/1990 Thompson et al.
4,971,845 A 11/1990 Aaker et al.
4,985,192 A 1/1991 Roeder et al.
5,000,500 A 3/1991 Almog
5,007,143 A 4/1991 Herrington
5,009,236 A 4/1991 Brothers
5,009,318 A 4/1991 Lepinoy
5,012,561 A 5/1991 Porchia et al.
5,017,021 A 5/1991 Simonsen et al.
5,022,530 A 6/1991 Zieke
5,033,868 A 7/1991 Peppiatt
RE33,674 E 8/1991 Uramoto
5,037,138 A 8/1991 McClintock et al.
5,041,316 A 8/1991 Parnell et al.
5,044,774 A 9/1991 Bullard et al.
5,053,091 A 10/1991 Giljam et al.
5,056,933 A 10/1991 Kamp
5,059,036 A 10/1991 Richison et al.
5,067,208 A 11/1991 Herrington, Jr. et al.
5,067,822 A 11/1991 Wirth et al.
5,069,962 A 12/1991 Okazaki et al.
5,070,584 A 12/1991 Dais et al.
5,088,162 A 2/1992 Allan
5,088,971 A 2/1992 Herrington
5,092,684 A 3/1992 Weeks
5,093,164 A 3/1992 Bauer et al.
5,093,188 A 3/1992 Dohrer
5,097,956 A 3/1992 Davis
5,112,138 A 5/1992 Peppiatt
5,119,531 A 6/1992 Berger et al.
5,120,586 A 6/1992 Nedzu et al.
5,121,995 A 6/1992 Newman et al.
5,128,182 A 7/1992 Bunker et al.
5,131,121 A 7/1992 Herrington, Jr. et al.
5,134,001 A 7/1992 Osgood
5,140,727 A 8/1992 Dais et al.
5,140,796 A 8/1992 Pope
5,141,577 A 8/1992 Porchia et al.
5,142,970 A 9/1992 ErkenBrack
5,145,258 A 9/1992 Schneck et al.
5,161,286 A 11/1992 Herrington, Jr. et al.
5,167,454 A 12/1992 Woods et al.
5,168,586 A 12/1992 Small
5,170,990 A 12/1992 Kamiya et al.
5,174,658 A 12/1992 Cook et al.
5,177,332 A 1/1993 Fong
5,179,767 A 1/1993 Allan
5,184,896 A 2/1993 Hammond et al.
5,186,543 A 2/1993 Cochran
5,188,461 A 2/1993 Sorenson
5,189,764 A 3/1993 Herrington et al.
5,192,135 A 3/1993 Woods et al.
5,198,055 A 3/1993 Wirth et al.
5,203,458 A 4/1993 Cornwell
5,208,096 A 5/1993 Dohrer
5,209,264 A 5/1993 Koyanagi
5,209,574 A 5/1993 Tilman
5,209,972 A 5/1993 Super et al.
5,211,481 A 5/1993 Tilman
5,212,855 A 5/1993 McGanty
5,216,787 A 6/1993 Custer et al.
5,228,271 A 7/1993 Wallace
5,230,430 A 7/1993 Kidder
D338,399 S 8/1993 Conte, Jr.
5,236,749 A 8/1993 Ewing
5,238,306 A 8/1993 Heintz et al.
5,240,112 A 8/1993 Newburger
5,242,516 A 9/1993 Custer et al.
5,242,757 A 9/1993 Buisine et al.
5,246,114 A 9/1993 Underwood
5,248,201 A 9/1993 Kettner et al.
5,252,281 A 10/1993 Kettner et al.
5,252,379 A 10/1993 Kuribayashi et al.
5,254,073 A 10/1993 Richison et al.
5,263,777 A 11/1993 Domke
RE34,477 E 12/1993 Cornwell
5,272,794 A 12/1993 Hamatani et al.
5,283,932 A 2/1994 Richardson et al.
RE34,554 E 3/1994 Ausnit
5,293,672 A 3/1994 Tominaga et al.
5,300,354 A 4/1994 Harita et al.
5,301,394 A 4/1994 Richardson et al.
5,301,395 A 4/1994 Richardson et al.
5,308,666 A 5/1994 Borchardt
5,320,889 A 6/1994 Bettle, III
5,324,572 A 6/1994 Kuechler et al.
5,326,176 A 7/1994 Domke
5,332,095 A 7/1994 Wu
5,333,736 A 8/1994 Kawamura
5,339,602 A 8/1994 Landers et al.
5,339,959 A 8/1994 Cornwell
5,342,684 A 8/1994 Carespodi
5,346,312 A 9/1994 Mabry et al.
5,351,369 A 10/1994 Swain
5,351,828 A 10/1994 Becker et al.
5,354,133 A 10/1994 Rapparini
5,356,222 A 10/1994 Kettner et al.
5,360,670 A 11/1994 Yonezu et al.
5,362,351 A 11/1994 Karszes
5,366,294 A 11/1994 Wirth et al.
5,368,394 A 11/1994 Scott et al.
5,371,925 A 12/1994 Sawatsky
5,376,392 A 12/1994 Ikegami et al.
5,382,470 A 1/1995 Vicik
5,384,942 A 1/1995 Siegel
5,388,910 A 2/1995 Koyanagi
5,397,182 A 3/1995 Gaible et al.
5,399,022 A 3/1995 Sheets
5,403,094 A 4/1995 Tomic
5,407,087 A 4/1995 Giblin et al.
RE34,929 E 5/1995 Kristen
5,415,904 A 5/1995 Takubo et al.
5,417,035 A 5/1995 English
5,417,495 A 5/1995 Branson
5,419,638 A 5/1995 Jamison
5,435,864 A 7/1995 Machacek et al.
5,443,851 A 8/1995 Christie et al.
5,445,870 A 8/1995 Buchner et al.

5,448,807 A 9/1995 Herrington, Jr.
5,450,963 A 9/1995 Carson
5,456,979 A 10/1995 Schirmer
5,462,473 A 10/1995 Sheller
5,469,966 A 11/1995 Boyer
5,474,818 A 12/1995 Ulrich et al.
5,480,030 A 1/1996 Sweeney et al.
5,482,375 A 1/1996 Richardson et al.
5,492,241 A 2/1996 Barnett et al.
5,494,165 A 2/1996 Detrick
5,509,734 A 4/1996 Ausnit
5,511,884 A 4/1996 Bruno et al.
5,520,463 A 5/1996 Tilman
5,523,236 A 6/1996 Nuzzo
5,525,363 A 6/1996 Herber et al.
5,526,843 A 6/1996 Wolf et al.
5,540,500 A 7/1996 Tanaka
5,540,557 A 7/1996 Carson
5,542,902 A 8/1996 Richison et al.
5,544,752 A 8/1996 Cox
5,545,419 A 8/1996 Brady et al.
5,549,944 A 8/1996 Abate
5,551,127 A 9/1996 May
5,553,942 A * 9/1996 Domke et al. ..... 383/101
5,554,423 A 9/1996 Abate
5,558,439 A 9/1996 Tilman
5,558,613 A 9/1996 Tilman et al.
5,566,429 A 10/1996 Martinez et al.
5,567,533 A 10/1996 Toney et al.
5,573,614 A 11/1996 Tilman et al.
5,577,305 A 11/1996 Johnson
5,584,409 A 12/1996 Chemberlen
5,587,192 A 12/1996 Beizermann
5,588,187 A 12/1996 Swain
5,592,697 A 1/1997 Young
5,603,995 A 2/1997 Takubo et al.
5,609,420 A 3/1997 Palmisano
5,618,111 A 4/1997 Porchia et al.
5,622,431 A 4/1997 Simonsen
5,628,566 A 5/1997 Schreiter
5,638,971 A 6/1997 Justesen
RE35,567 E 7/1997 Newsome
5,653,251 A 8/1997 Handler
5,655,273 A 8/1997 Tomic et al.
5,655,842 A 8/1997 Hagino
5,660,479 A 8/1997 May et al.
5,664,303 A 9/1997 Johnson
5,669,715 A 9/1997 Dobreski et al.
5,672,009 A 9/1997 Malin
5,689,866 A 11/1997 Kasai et al.
5,692,837 A 12/1997 Beer
5,693,283 A 12/1997 Fehn
5,699,838 A 12/1997 Catallo et al.
5,700,091 A 12/1997 Tanaka et al.
5,701,996 A 12/1997 Goto et al.
5,709,479 A 1/1998 Bell
5,709,915 A 1/1998 Tomic et al.
5,713,669 A 2/1998 Thomas et al.
5,716,138 A 2/1998 Southwell
5,718,024 A 2/1998 Robbins
5,729,876 A 3/1998 Johnson
5,730,919 A 3/1998 Wilfong et al.
5,733,619 A 3/1998 Patel et al.
5,735,317 A 4/1998 Wu
5,735,395 A 4/1998 Lo
5,749,493 A 5/1998 Boone et al.
5,749,658 A 5/1998 Kettner
5,753,895 A 5/1998 Olson et al.
5,769,772 A 6/1998 Wiley
5,770,287 A 6/1998 Miranda et al.
5,774,954 A 7/1998 Ramsey et al.
5,775,812 A 7/1998 St. Phillips et al.
5,782,562 A 7/1998 Anspacher
5,782,733 A 7/1998 Yeager
5,784,862 A 7/1998 Germano
5,786,010 A 7/1998 Yannuzzi, Jr.
5,791,783 A 8/1998 Porchia et al.
5,794,315 A 8/1998 Crabtree et al.
5,804,265 A 9/1998 Saad et al.
5,827,163 A 10/1998 Kettner
5,827,586 A 10/1998 Yamashita et al.
5,829,884 A 11/1998 Yeager
5,830,545 A 11/1998 Frisk
5,833,791 A 11/1998 Bryniarski et al.
5,839,582 A 11/1998 Strong et al.
5,839,831 A 11/1998 Mazzocchi
5,839,832 A 11/1998 Hagino
5,843,578 A 12/1998 Sasaki et al.
5,855,498 A 1/1999 Spector
5,871,281 A 2/1999 Stolmeier et al.
5,871,790 A 2/1999 Monier et al.
5,874,155 A 2/1999 Gehrke et al.
5,875,611 A 3/1999 Plourde
5,881,881 A 3/1999 Carrington
5,881,883 A 3/1999 Siegelman
5,882,120 A 3/1999 Bell
5,893,461 A 4/1999 Walters
5,893,645 A 4/1999 May
5,894,707 A 4/1999 May
5,894,929 A 4/1999 Kai et al.
5,898,113 A 4/1999 Vecere
5,902,046 A 5/1999 Shibata
5,902,047 A 5/1999 Yeager
5,911,508 A 6/1999 Dobreski et al.
5,915,596 A 6/1999 Credle, Jr.
5,919,535 A 7/1999 Dobreski et al.
5,919,547 A 7/1999 Kocher et al.
5,924,173 A 7/1999 Dobreski et al.
5,924,795 A 7/1999 Thompson et al.
5,927,336 A 7/1999 Tanaka et al.
5,927,855 A 7/1999 Tomic et al.
5,928,762 A 7/1999 Aizawa et al.
5,930,877 A 8/1999 Thorpe et al.
5,931,189 A 8/1999 Sweeney et al.
5,931,582 A 8/1999 Nichols
5,933,927 A 8/1999 Miller et al.
5,941,421 A 8/1999 Overman et al.
5,941,643 A 8/1999 Linkiewicz
5,944,425 A 8/1999 Forman
5,947,603 A 9/1999 Tilman
5,951,453 A 9/1999 Yeager
5,953,796 A 9/1999 McMahon et al.
5,954,196 A 9/1999 Lin
5,954,433 A 9/1999 Yeager
5,956,815 A 9/1999 O'Connor et al.
5,964,532 A 10/1999 St. Phillips et al.
5,965,224 A 10/1999 Chen et al.
5,965,235 A 10/1999 McGuire et al.
5,967,664 A 10/1999 Giles et al.
5,971,613 A 10/1999 Bell
5,981,028 A 11/1999 Sugawa et al.
5,983,466 A 11/1999 Petkovsek
5,985,391 A 11/1999 Denehy et al.
5,988,426 A 11/1999 Stern
5,988,880 A 11/1999 Tomic
5,989,608 A 11/1999 Mizuno
5,992,442 A 11/1999 Urquhart et al.
5,992,635 A 11/1999 Walters
5,996,800 A 12/1999 Pratt
6,004,032 A 12/1999 Kapperman et al.
6,009,603 A 1/2000 Gallagher
6,010,244 A 1/2000 Dobreski et al.
6,012,264 A 1/2000 Linkiewicz
6,014,795 A 1/2000 McMahon et al.
6,017,412 A 1/2000 Van Erden et al.
6,019,512 A 2/2000 Yeager 6,021,624 A 2/2000 Richison et al.
6,023,914 A 2/2000 Richison et al.
6,024,220 A 2/2000 Smith et al.
6,029,810 A 2/2000 Chen
6,030,122 A 2/2000 Ramsey et al.
6,033,113 A 3/2000 Anderson
6,033,114 A 3/2000 Grimm et al.
6,039,182 A 3/2000 Light
6,044,621 A 4/2000 Malin et al.
6,045,264 A 4/2000 Miniea
6,045,546 A 4/2000 Drago et al.
6,045,648 A 4/2000 Palmgren et al.
6,047,450 A 4/2000 Machacek et al.
6,053,635 A 4/2000 Anderson et al.
6,056,439 A 5/2000 Graham
6,059,456 A 5/2000 May
6,059,457 A 5/2000 Sprehe et al.
6,068,898 A 5/2000 Oyama
6,070,397 A 6/2000 Bachhuber
6,070,728 A 6/2000 Overby et al.
6,071,011 A 6/2000 Thomas et al.
6,071,626 A 6/2000 Frisk
6,074,096 A 6/2000 Tilman
6,076,967 A 6/2000 Beaudette
6,077,208 A 6/2000 Larkin et al.
6,077,578 A 6/2000 Valyi
6,080,252 A 6/2000 Plourde
6,082,897 A 7/2000 Galomb
6,083,584 A 7/2000 Smith et al.
6,085,906 A 7/2000 Lambert
6,085,922 A 7/2000 Esser
6,092,931 A 7/2000 Tilman
6,103,050 A 8/2000 Krueger
6,110,586 A 8/2000 Johnson
6,112,374 A 9/2000 Van Erden
6,116,781 A 9/2000 Skeens
6,117,505 A 9/2000 Weiss et al.
6,120,817 A 9/2000 Archibald et al.
6,126,013 A 10/2000 Miller
6,126,975 A 10/2000 Archibald et al.
6,132,089 A 10/2000 Galomb et al.
6,138,329 A 10/2000 Johnson
6,146,764 A 11/2000 Suokas et al.
6,148,588 A 11/2000 Thomas et al.
6,149,302 A 11/2000 Taheri
6,149,304 A 11/2000 Hamilton et al.
6,152,601 A 11/2000 Johnson
6,156,363 A 12/2000 Chen et al.
6,164,825 A 12/2000 Larkin et al.
6,167,597 B1 1/2001 Malin
6,170,985 B1 1/2001 Shabram, Jr. et al.
6,176,613 B1 1/2001 Chen
6,177,172 B1 1/2001 Yeager
6,178,602 B1 1/2001 Burke et al.
6,182,337 B1 2/2001 Machacek et al.
6,182,850 B1 * 2/2001 Marbler et al. ..... 220/359.3
6,185,796 B1 2/2001 Ausnit
6,194,011 B1 2/2001 Glaser
6,194,043 B1 2/2001 Fehn
6,202,849 B1 3/2001 Graham
6,203,867 B1 3/2001 Derkach et al.
6,203,915 B1 3/2001 Prissok et al.
6,209,287 B1 4/2001 Thieman
6,217,216 B1 4/2001 Taheri
6,218,024 B1 4/2001 Tamber et al.
6,220,754 B1 4/2001 Stiglic et al.
6,224,262 B1 5/2001 Hogan et al.
6,227,706 B1 5/2001 Tran
6,231,236 B1 5/2001 Tilman
6,231,975 B1 5/2001 Kong et al.
6,240,941 B1 6/2001 Small et al.
6,244,021 B1 6/2001 Ausnit et al.
6,244,748 B1 6/2001 Kasai et al.
6,248,442 B1 6/2001 Kong et al.
6,251,489 B1 6/2001 Weiss et al.
6,257,763 B1 7/2001 Stolmeier et al.
6,270,257 B1 8/2001 Yeager
6,270,950 B1 8/2001 Bourdelais et al.
6,273,609 B1 8/2001 Johnson
6,274,181 B1 8/2001 Richison et al.
6,279,298 B1 8/2001 Thomas et al.
6,279,745 B1 8/2001 Huynen et al.
6,286,191 B2 9/2001 Van Erden
6,286,999 B1 9/2001 Cappel et al.
6,287,001 B1 9/2001 Buchman
6,289,561 B1 9/2001 Provan et al.
6,290,391 B1 9/2001 Buchman
6,290,392 B1 9/2001 Sandor
6,292,986 B1 9/2001 Provan et al.
6,293,701 B1 9/2001 Tomic
6,294,264 B1 9/2001 Piper et al.
6,299,351 B1 10/2001 Warr
6,299,353 B1 10/2001 Piechocki et al.
6,299,720 B1 10/2001 Van Erden
6,303,199 B1 10/2001 Takada et al.
6,306,472 B1 10/2001 Buelow
6,316,114 B1 11/2001 Comer et al.
6,317,939 B1 11/2001 Malin
6,318,894 B1 11/2001 Derenthal
6,321,423 B1 11/2001 Johnson
6,334,711 B1 1/2002 Risgalla et al.
6,344,258 B1 2/2002 Rasmussen
6,345,911 B1 2/2002 Young et al.
6,347,437 B2 2/2002 Provan et al.
6,354,738 B1 3/2002 Buckman et al.
6,355,336 B1 3/2002 Wakabayashi et al.
6,357,915 B2 3/2002 Anderson
6,360,513 B1 3/2002 Strand et al.
6,361,209 B1 3/2002 LaRue et al.
6,361,211 B1 3/2002 Tilman
6,361,212 B1 3/2002 Sprehe et al.
6,361,843 B1 3/2002 Smith et al.
6,364,530 B1 4/2002 Buchman
6,367,976 B1 4/2002 Bannister
6,371,642 B1 4/2002 Nelson et al.
6,371,643 B2 4/2002 Saad et al.
6,371,644 B1 4/2002 Forman
6,372,359 B1 4/2002 Hayashi et al.
6,374,855 B1 4/2002 Hansen
6,376,035 B1 4/2002 Dobreski et al.
6,378,272 B1 4/2002 Archibald et al.
6,385,818 B1 5/2002 Savicki, Sr.
6,386,760 B1 5/2002 Tomic
6,390,676 B1 5/2002 Colombo et al.
6,391,404 B1 5/2002 Rosenbaum et al.
6,402,375 B1 6/2002 Schreiter et al.
6,403,174 B1 6/2002 Copeta
6,408,872 B1 6/2002 Skeens et al.
6,413,597 B1 7/2002 Hirai
6,439,771 B1 8/2002 Herrington, Jr.
6,450,686 B1 9/2002 May
6,451,426 B2 9/2002 Kong et al.
6,461,042 B1 10/2002 Tomic et al.
6,468,332 B2 10/2002 Goglio et al.
6,479,115 B2 11/2002 Fehn
6,481,889 B2 11/2002 Delsahut
6,481,890 B1 11/2002 VandenHeuvel
6,487,758 B2 12/2002 Shaffer et al.
6,489,022 B1 12/2002 Hamilton et al.
6,491,166 B1 12/2002 Compton et al.
6,491,433 B2 12/2002 Shabram, Jr. et al.
6,499,878 B1 12/2002 Dobreski et al.
6,499,879 B2 12/2002 Schneck
6,500,505 B2 12/2002 Piper et al.
6,503,588 B1 1/2003 Hayashi et al.
6,505,383 B2 1/2003 Machacek et al.

6,506,464 B1 1/2003 Montenieri et al.
6,513,659 B1 2/2003 Ogura et al.
6,517,242 B1 2/2003 Buchman
6,521,312 B1 2/2003 Keiser
6,524,002 B2 2/2003 Tomic
6,526,632 B1 3/2003 Blythe et al.
6,527,003 B1 3/2003 Webster
6,530,870 B2 3/2003 Buchman et al.
6,533,456 B1 3/2003 Buchman
D473,761 S 4/2003 Wilk et al.
6,539,594 B1 4/2003 Kasai et al.
6,550,223 B2 4/2003 Xiong et al.
6,550,965 B2 4/2003 Shaffer et al.
6,550,966 B1 4/2003 Saad et al.
6,568,046 B1 5/2003 Savicki et al.
6,571,430 B1 6/2003 Savicki et al.
6,572,267 B1 6/2003 Forman
6,575,191 B2 6/2003 Skeens et al.
6,576,329 B2 6/2003 Kong
6,576,348 B2 6/2003 Eggers et al.
6,579,584 B1 6/2003 Compton
6,579,621 B1 6/2003 Shah
6,581,253 B2 6/2003 ErkenBrack
6,581,641 B2 6/2003 Skeens et al.
6,595,689 B1 7/2003 Borchardt et al.
D478,774 S 8/2003 Wilk et al.
6,602,580 B1 8/2003 Hamilton et al.
6,602,590 B2 8/2003 Ting et al.
6,604,634 B2 8/2003 Su
6,609,353 B1 8/2003 McMahon et al.
6,609,827 B2 8/2003 Bois et al.
6,609,828 B2 8/2003 Schneider et al.
6,611,996 B2 9/2003 Blythe et al.
6,620,474 B1 9/2003 Regnier et al.
6,622,857 B2 9/2003 Ohtsubo et al.
6,623,866 B2 9/2003 Migliorini et al.
6,632,021 B2 10/2003 Bois et al.
6,634,384 B2 10/2003 Skeens et al.
6,637,937 B2 10/2003 Bois
6,637,939 B2 10/2003 Huffer
6,656,548 B1 12/2003 Beckwith et al.
6,659,643 B2 12/2003 Plourde et al.
6,662,827 B1 12/2003 Clougherty et al.
6,663,284 B2 12/2003 Buckingham et al.
6,663,947 B2 12/2003 Freedman et al.
6,666,580 B2 12/2003 Bois
6,667,083 B2 12/2003 Hayashi et al.
6,675,982 B2 1/2004 Heil et al.
6,679,027 B2 1/2004 Schreiter
6,680,104 B2 1/2004 Boris et al.
6,682,792 B2 1/2004 Schmal et al.
6,685,614 B1 2/2004 Arnell
6,691,383 B2 2/2004 Linton
6,692,147 B2 2/2004 Nelson
6,694,704 B1 2/2004 Ausnit
6,698,925 B2 3/2004 Bentsen
6,702,460 B1 3/2004 Geyer
6,706,377 B2 3/2004 Peet
6,712,334 B2 3/2004 Motonaka et al.
6,712,509 B2 3/2004 Cappel
6,713,152 B2 3/2004 Chen et al.
6,715,644 B2 4/2004 Wilford
6,721,999 B2 4/2004 Meager
6,729,473 B2 5/2004 Anderson
6,739,755 B2 5/2004 Schreiter
6,740,019 B2 5/2004 Bois
6,753,370 B2 6/2004 Nakatsukasa et al.
6,755,568 B2 6/2004 Malone et al.
6,767,131 B2 7/2004 Taheri
6,773,163 B2 8/2004 Ichikawa et al.
6,777,089 B1 8/2004 Königer et al.
6,780,146 B2 8/2004 Thomas et al.
6,786,641 B2 9/2004 Plourde
6,789,690 B2 9/2004 Nieh et al.
6,794,021 B2 9/2004 Bader
6,796,933 B2 9/2004 Bois
6,799,680 B2 10/2004 Mak
6,799,890 B2 10/2004 Schneider et al.
6,810,642 B2 11/2004 Cortigiano, Sr.
6,817,763 B2 11/2004 Tomic
6,820,391 B2 11/2004 Barmore et al.
6,821,589 B2 11/2004 Dobreski et al.
6,824,885 B2 11/2004 Fitch et al.
6,827,105 B1 12/2004 Marble et al.
6,827,492 B2 12/2004 Cook
6,830,377 B2 12/2004 Schneider
6,833,170 B1 12/2004 Knoerzer et al.
6,835,257 B2 12/2004 Perrine
6,837,268 B2 1/2005 Skeens et al.
6,845,598 B1 1/2005 Melchoir
6,846,107 B2 1/2005 Sweeney et al.
6,846,532 B1 1/2005 Bensur
6,846,551 B2 1/2005 Genske et al.
RE38,694 E 2/2005 Nelson
6,851,248 B2 2/2005 Knight et al.
6,854,886 B2 2/2005 Piechocki et al.
6,862,867 B2 3/2005 Cady et al.
6,862,980 B2 3/2005 Heil et al.
6,872,458 B1 3/2005 Rudd et al.
6,874,935 B2 4/2005 Edelman et al.
6,874,937 B2 4/2005 Ausnit
6,874,938 B2 4/2005 Price et al.
6,877,898 B2 4/2005 Berich et al.
6,883,665 B1 4/2005 Ahn
6,884,207 B2 4/2005 Pokusa
6,884,483 B2 4/2005 Hayashi et al.
6,901,637 B2 6/2005 Machacek
6,902,795 B1 6/2005 Ishii et al.
6,910,805 B2 6/2005 Johnson
6,910,806 B2 6/2005 Strand et al.
6,913,387 B2 7/2005 Strand et al.
6,913,388 B2 7/2005 Laske
6,923,574 B2 8/2005 Siegel
6,925,688 B1 8/2005 Savicki
6,929,127 B1 8/2005 Delk, Sr.
6,932,509 B2 8/2005 Shah et al.
6,939,042 B2 9/2005 Rusnak et al.
6,939,597 B2 9/2005 Winget et al.
6,945,392 B2 9/2005 Furukawa et al.
6,946,176 B2 9/2005 Jousse et al.
6,951,420 B1 10/2005 Leighton
6,954,969 B1 10/2005 Sprehe
6,955,465 B2 10/2005 Machacek et al.
6,957,915 B2 10/2005 Tankersley
6,960,374 B1 11/2005 Terada et al.
6,964,519 B2 11/2005 ErkenBrack
6,974,256 B2 12/2005 Kinigakis et al.
6,976,669 B2 12/2005 Van Zijll Langhout et al.
6,979,495 B2 12/2005 Keung et al.
6,983,845 B2 1/2006 Shah et al.
6,984,278 B2 1/2006 Anderson et al.
6,988,828 B2 1/2006 Linneweil
6,991,109 B1 1/2006 Shannon et al.
6,993,886 B2 2/2006 Johnson
6,996,879 B1 2/2006 Savicki
7,001,659 B2 2/2006 Iriyama
7,004,209 B2 2/2006 Davis et al.
7,004,632 B2 2/2006 Hamilton et al.
7,011,615 B2 3/2006 Price et al.
7,014,363 B2 3/2006 Hanson
7,022,058 B2 4/2006 Lee
7,026,417 B2 4/2006 Yang et al.
7,036,988 B2 5/2006 Olechowski
7,045,190 B2 5/2006 Inagaki et al.
7,048,136 B2 5/2006 Havens et al.
7,051,762 B2 5/2006 Haamer 7,077,570 B2 7/2006 Fukumori et al.
7,077,923 B2 7/2006 Lin
7,087,130 B2 8/2006 Wu et al.
7,087,277 B2 8/2006 Yang et al.
7,090,397 B2 8/2006 Stolmeier
7,090,398 B2 8/2006 Shibata
7,096,893 B2 8/2006 Vilalta et al.
7,097,359 B2 8/2006 Plourde et al.
7,108,147 B2 9/2006 Cheung
7,131,550 B2 11/2006 Vilalta et al.
7,138,025 B2 11/2006 Wu et al.
7,144,615 B2 12/2006 Peiffer et al.
7,157,126 B2 1/2007 Cosentino et al.
7,162,779 B2 1/2007 MacHacek
7,163,338 B2 1/2007 McCracken et al.
7,178,555 B2 2/2007 Engel et al.
7,244,223 B2 7/2007 Hartman et al.
2001/0012550 A1 8/2001 Fehn
2001/0031371 A1 10/2001 Kong et al.
2001/0034999 A1 11/2001 Xiong et al.
2001/0038897 A1 11/2001 Curie et al.
2002/0012803 A1 1/2002 Kending
2002/0022144 A1 2/2002 Yang et al.
2002/0041964 A1 4/2002 Winget et al.
2002/0043052 A1 4/2002 Gyorffy
2002/0090151 A1 7/2002 Skeens et al.
2002/0097923 A1 7/2002 Dobreski et al.
2002/0124471 A1 9/2002 Anderson et al.
2002/0134046 A1 9/2002 Bois
2002/0146551 A1 10/2002 Freedman et al.
2002/0160167 A1 10/2002 Bader
2002/0168118 A1 11/2002 Price
2002/0168119 A1 11/2002 Herrington, Jr.
2002/0168489 A1 11/2002 Ting et al.
2002/0168512 A1 11/2002 Eggers et al.
2002/0182390 A1 12/2002 Migliorini et al.
2002/0187326 A1 12/2002 Kong
2002/0191872 A1 12/2002 Trani et al.
2003/0012901 A1 1/2003 Bezek et al.
2003/0016887 A1 1/2003 Su
2003/0021925 A1 1/2003 Schmal et al.
2003/0024847 A1 2/2003 Malaspina
2003/0031387 A1 2/2003 Gipson et al.
2003/0053722 A1 3/2003 Eggermont
2003/0059132 A1 3/2003 Vetter
2003/0095727 A1 5/2003 Leighton
2003/0102245 A1 6/2003 Wang
2003/0116466 A1 6/2003 Goto
2003/0118253 A1 6/2003 Machacek
2003/0136798 A1 7/2003 Wilford
2003/0169948 A1 9/2003 Fenzl et al.
2003/0175457 A1 9/2003 Jousse et al.
2003/0207061 A1 11/2003 Hayashi et al.
2003/0219174 A1 11/2003 Piechocki
2003/0219177 A1 11/2003 Salvaro
2003/0219557 A1 11/2003 Denehy et al.
2003/0223654 A1 12/2003 Gerrits
2003/0228077 A1 12/2003 Laske
2003/0235669 A1 12/2003 Yang et al.
2004/0000336 A1 1/2004 Goglio
2004/0000503 A1 1/2004 Shah et al.
2004/0001651 A1 1/2004 Pawloski
2004/0007494 A1 1/2004 Popeil et al.
2004/0014579 A1 1/2004 Sweeney et al.
2004/0022457 A1 2/2004 Brown et al.
2004/0028856 A1 2/2004 Smith et al.
2004/0040961 A1 3/2004 Vilalta et al.
2004/0049896 A1 3/2004 Savicki
2004/0050745 A1 3/2004 Lee et al.
2004/0057636 A1 3/2004 Ishizaki
2004/0058178 A1 3/2004 Yang et al.
2004/0078939 A1 4/2004 Pawloski
2004/0081375 A1 4/2004 Pokusa
2004/0091179 A1 5/2004 Anderson
2004/0091185 A1 5/2004 Shibata
2004/0091186 A1 5/2004 Shibata
2004/0098845 A1 5/2004 Fukumori et al.
2004/0105600 A1 6/2004 Floyd, Jr.
2004/0114837 A1 6/2004 Koyanagi
2004/0136617 A1 7/2004 Gerrits
2004/0136618 A1 7/2004 Ausnit et al.
2004/0136622 A1 7/2004 Shigeta et al.
2004/0161175 A1 8/2004 Malone et al.
2004/0165794 A1 8/2004 Plourde et al.
2004/0177595 A1 9/2004 Kozak
2004/0191438 A1 9/2004 Cosentino et al.
2004/0208400 A1 10/2004 Linneweil
2004/0211698 A1 10/2004 John Mak
2004/0213967 A1 10/2004 Peiffer et al.
2004/0223667 A1 11/2004 Shah et al.
2004/0234170 A1 11/2004 Pawloski et al.
2004/0252915 A1 12/2004 Nelson
2004/0256050 A1 12/2004 Wu
2005/0008266 A1 1/2005 Crunkleton et al.
2005/0014011 A1 1/2005 Oya
2005/0022472 A1 2/2005 Brakes et al.
2005/0025394 A1 2/2005 Kinigakis et al.
2005/0029704 A1 2/2005 Wu et al.
2005/0034425 A1 2/2005 Johnson
2005/0034806 A1 2/2005 Wu et al.
2005/0034807 A1 2/2005 Wu et al.
2005/0035020 A1 2/2005 Wu et al.
2005/0036717 A1 2/2005 Wu et al.
2005/0036718 A1 2/2005 Wu et al.
2005/0036719 A1 2/2005 Wu et al.
2005/0037163 A1 2/2005 Wu et al.
2005/0037164 A1 2/2005 Wu et al.
2005/0041889 A1 2/2005 Scarberry
2005/0041894 A1 2/2005 Hanson
2005/0042441 A1 2/2005 Peiffer et al.
2005/0042468 A1 2/2005 Peiffer et al.
2005/0043158 A1 2/2005 Wu et al.
2005/0061812 A1 3/2005 Vilalta et al.
2005/0063620 A1 3/2005 Anderson
2005/0065007 A1 3/2005 Wu et al.
2005/0069227 A1 3/2005 Steele
2005/0069229 A1 3/2005 McCracken et al.
2005/0089250 A1 4/2005 Laske et al.
2005/0103798 A1 5/2005 Luigi
2005/0123748 A1 6/2005 Paris
2005/0135710 A1 6/2005 Melchoir
2005/0147330 A1 7/2005 Lee
2005/0152623 A1 7/2005 Marley et al.
2005/0152624 A1 7/2005 Versluys
2005/0172577 A1 8/2005 Oltrogge
2005/0190995 A1 9/2005 Koyanagi
2005/0196076 A1 9/2005 Tanaka et al.
2005/0196078 A1 9/2005 McKinney et al.
2005/0205455 A1 9/2005 Harrison
2005/0208282 A1 9/2005 Woods, Jr. et al.
2005/0220373 A1 10/2005 Wu
2005/0220374 A1 10/2005 Thomas et al.
2005/0220376 A1 10/2005 Tsukanome et al.
2005/0229365 A1 10/2005 Offa-Jones
2005/0235468 A1 10/2005 Borchardt et al.
2005/0238263 A1 10/2005 Ping
2005/0244083 A1 11/2005 McMahon et al.
2005/0245376 A1 11/2005 Savicki et al.
2005/0251973 A1 11/2005 Sprehe
2005/0254731 A1 11/2005 Berbert et al.
2005/0259894 A1 11/2005 Swartz et al.
2005/0259895 A1 11/2005 Kozak
2005/0271308 A1 12/2005 Pawloski
2005/0276524 A1 12/2005 Taheri
2005/0281489 A1 12/2005 Yeh et al.
2005/0281490 A1 12/2005 Schneider et al.

| | | | | |
|---|---|---|---|---|
| 2005/0281493 | A1 | 12/2005 | Heinemeier et al. | |
| 2005/0281494 | A1 | 12/2005 | Allen et al. | |
| 2005/0282695 | A1 | 12/2005 | Yeager | |
| 2005/0286808 | A1 | 12/2005 | Zimmerman et al. | |
| 2005/0286810 | A1 | 12/2005 | Sprague et al. | |
| 2005/0286811 | A1 | 12/2005 | Sprague et al. | |
| 2005/0286812 | A1 | 12/2005 | Sprague et al. | |
| 2005/0286813 | A1 | 12/2005 | Borchardt | |
| 2005/0286817 | A1 | 12/2005 | Hall et al. | |
| 2006/0008185 | A1 | 1/2006 | Borchardt | |
| 2006/0008187 | A1 | 1/2006 | Armstrong | |
| 2006/0013513 | A1 | 1/2006 | Meyer | |
| 2006/0013514 | A1 | 1/2006 | Wu | |
| 2006/0029299 | A1 | 2/2006 | Share et al. | |
| 2006/0030472 | A1 | 2/2006 | Hartman et al. | |
| 2006/0034551 | A1 | 2/2006 | Linneweil | |
| 2006/0035046 | A1 | 2/2006 | Lee | |
| 2006/0035777 | A1 | 2/2006 | Johnson | |
| 2006/0045390 | A1 | 3/2006 | Sill et al. | |
| 2006/0045392 | A1 | 3/2006 | Bannister et al. | |
| 2006/0048483 | A1 | 3/2006 | Tilman et al. | |
| 2006/0048486 | A1 | 3/2006 | Laing et al. | |
| 2006/0050999 | A1 | 3/2006 | Blythe et al. | |
| 2006/0053749 | A1 | 3/2006 | Scanlan | |
| 2006/0072860 | A1 | 4/2006 | Wu | |
| 2006/0073291 | A1 | 4/2006 | Wu | |
| 2006/0076058 | A1 | 4/2006 | Rypstra | |
| 2006/0093242 | A1 | 5/2006 | Anzini et al. | |
| 2006/0104548 | A1 | 5/2006 | Schreiter | |
| 2006/0105166 | A1 | 5/2006 | Lischefski et al. | |
| 2006/0110078 | A1 | 5/2006 | Sholzberg et al. | |
| 2006/0110079 | A1 | 5/2006 | Zimmerman et al. | |
| 2006/0111226 | A1 | 5/2006 | Anzini et al. | |
| 2006/0115187 | A1 | 6/2006 | Ausnit et al. | |
| 2006/0120632 | A1 | 6/2006 | Han | |
| 2006/0120633 | A1 | 6/2006 | Goldenberg et al. | |
| 2006/0131328 | A1 | 6/2006 | Anderson | |
| 2006/0157140 | A1 | 7/2006 | Bergman et al. | |
| 2006/0159372 | A1 | 7/2006 | Plourde et al. | |
| 2006/0159576 | A1 | 7/2006 | Bergman et al. | |
| 2006/0165316 | A1 | 7/2006 | Cheung | |
| 2006/0172137 | A1 | 8/2006 | Champion | |
| 2006/0177155 | A1 | 8/2006 | Owen | |
| 2006/0177156 | A1 | 8/2006 | Owen et al. | |
| 2006/0179620 | A1 | 8/2006 | MacHacek | |
| 2006/0182371 | A1 | 8/2006 | Borchardt | |
| 2006/0193540 | A1 | 8/2006 | Borchardt | |
| 2006/0201576 | A1 | 9/2006 | Domenig | |
| 2006/0225787 | A1 | 10/2006 | Newrones et al. | |
| 2006/0228057 | A1 | 10/2006 | Newrones et al. | |
| 2006/0251841 | A1 | 11/2006 | Yang et al. | |
| 2006/0263497 | A1 | 11/2006 | Hoffman | |
| 2006/0283148 | A1 | 12/2006 | Zimmermann et al. | |
| 2006/0292322 | A1 | 12/2006 | Nakajima et al. | |
| 2007/0090109 | A1 | 4/2007 | Gustavsson | |
| 2007/0110343 | A1* | 5/2007 | Buchman et al. | 383/63 |
| 2007/0130733 | A1 | 6/2007 | Kasai | |
| 2007/0154118 | A1 | 7/2007 | Tilman et al. | |
| 2007/0172157 | A1 | 7/2007 | Buchman | |
| 2007/0232473 | A1 | 10/2007 | Hartman et al. | |
| 2007/0263948 | A1* | 11/2007 | Buchman et al. | 383/103 |
| 2008/0144979 | A1* | 6/2008 | Capt et al. | 383/207 |
| 2009/0123094 | A1* | 5/2009 | Kreymborg et al. | 383/103 |

FOREIGN PATENT DOCUMENTS

| | | |
|---|---|---|
| DE | 1 901 372 U | 7/1964 |
| DE | 1 290 073 | 2/1969 |
| DE | 1 486 280 | 4/1969 |
| DE | 1 486 733 | 6/1969 |
| DE | 1 411 644 | 7/1969 |
| DE | 23 31 862 | 1/1975 |
| DE | 24 54 248 | 5/1976 |
| DE | 27 47 071 | 4/1979 |
| DE | 28 48 835 | 5/1980 |
| DE | 33 12 887 | 10/1984 |
| DE | 34 11 371 | 10/1985 |
| DE | 35 21 373 | 12/1986 |
| DE | 93 00 361 | 1/1994 |
| DE | 43 05 065 | 8/1994 |
| DE | 198 43 430 | 2/2000 |
| EP | 144 011 | 6/1985 |
| EP | 149 695 | 7/1985 |
| EP | 373 833 | 6/1990 |
| EP | 450 741 | 10/1991 |
| EP | 505 057 | 9/1992 |
| EP | 633 193 | 1/1995 |
| EP | 729 901 | 9/1996 |
| EP | 767 105 | 4/1997 |
| EP | 808 776 | 11/1997 |
| EP | 1 231 155 | 8/2002 |
| EP | 1 407 681 | 4/2004 |
| FR | 2 353 452 | 6/1976 |
| FR | 2 380 953 | 2/1978 |
| FR | 2 603 164 | 3/1988 |
| FR | 2 695 108 | 3/1994 |
| GB | 154244 | 11/1920 |
| GB | 961222 | 6/1964 |
| GB | 1016476 | 1/1966 |
| GB | 1046963 | 10/1966 |
| GB | 1121514 | 7/1968 |
| GB | 1399502 | 7/1975 |
| GB | 1548244 | 7/1979 |
| GB | 2028081 | 3/1980 |
| GB | 1583503 | 1/1981 |
| GB | 2237553 | 5/1991 |
| JP | 55-090364 | 7/1980 |
| JP | 57-21579 | 2/1982 |
| JP | 61-166960 | 10/1986 |
| JP | 62-99534 | 6/1987 |
| JP | 62-192779 | 8/1987 |
| JP | 63-6278 | 1/1988 |
| JP | 63-6279 | 1/1988 |
| JP | 63-203559 | 8/1988 |
| JP | 1-099925 | 4/1989 |
| JP | 1-279073 | 11/1989 |
| JP | 3-212355 | 9/1991 |
| JP | 4-13543 | 2/1992 |
| JP | 4-13544 | 2/1992 |
| JP | 4-60847 | 5/1992 |
| JP | 5-051039 | 3/1993 |
| JP | 5-124656 | 5/1993 |
| JP | 6-3846 | 1/1994 |
| JP | 6-99991 | 4/1994 |
| JP | 6-329179 | 11/1994 |
| JP | 7-839 | 1/1995 |
| JP | 8-011942 | 1/1996 |
| JP | 8-198274 | 8/1996 |
| JP | 2000-281084 | 10/2000 |
| JP | 2001-173818 | 6/2001 |
| JP | 2001-233383 | 8/2001 |
| JP | 2001-247137 | 9/2001 |
| JP | 2002-193273 | 7/2002 |
| JP | 2002-302164 | 10/2002 |
| JP | 2003-507264 | 2/2003 |
| JP | 2004-123228 | 4/2004 |
| JP | 2004-531435 | 10/2004 |
| JP | 2004-359292 | 12/2004 |
| JP | 2006-044751 | 2/2006 |
| WO | WO 88/07479 | 10/1988 |
| WO | WO 98/57862 | 12/1998 |
| WO | WO 01/94227 | 12/2001 |
| WO | WO 02/14161 | 2/2002 |
| WO | WO 02/30772 | 4/2002 |
| WO | WO 02/074522 | 9/2002 |
| WO | WO 03/001096 | 1/2003 |

| | | |
|---|---|---|
| WO | WO 2004/002840 | 1/2004 |
| WO | WO 2004/002841 | 1/2004 |
| WO | WO 2004/002850 | 1/2004 |
| WO | WO 2004/078590 | 9/2004 |
| WO | WO 2004/078591 | 9/2004 |
| WO | WO 2004/078609 | 9/2004 |
| WO | WO 2004/108556 | 12/2004 |
| WO | WO 2004/108557 | 12/2004 |
| WO | WO 2005/000706 | 1/2005 |
| WO | WO 2005/016774 | 2/2005 |
| WO | WO 2005/040005 | 5/2005 |
| WO | WO 2006/127739 | 11/2006 |

* cited by examiner

VALVE FOR A RECLOSEABLE CONTAINER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to valves, and particularly to a valve that may be used on a reclosable container, such as a pouch.

2. Description of the Background of the Invention

Food or other perishables are often stored in reclosable containers such as reclosable thermoplastic pouches. To keep food stored inside a pouch fresh for an extended period, a user may evacuate air out of the pouch before completely sealing a closure mechanism of the pouch. Other reclosable pouches have been developed that have a valve that allows air to be evacuated from the pouch after the closure mechanism has already been sealed.

Some pouch valves have a patch of thermoplastic material covering an aperture in a pouch wall and sealed over a limited area of the pouch wall around a periphery of the patch. The patch has an aperture therethrough that is offset from the aperture in the pouch wall. Pressure from outside of the pouch forces the patch against the pouch wall keeping the valve closed. However, pressure from within the pouch forces the patch to separate from the pouch wall to allow air to flow through both apertures and out of the pouch. Another valve has a highly cohesive fluid in the space between the offset apertures to resist separation of the patch and the pouch wall. Still another valve has a porous layer of material secured over the aperture in the pouch wall, wherein the porous layer has a smaller area than the patch.

Other valves have a cover flap disposed over an aperture in a pouch wall, wherein the cover flap lacks an aperture. The valves have an unsealed edge that provides a path for escaping air. One such valve has a separator layer disposed between an adhesive layer disposed on an inner surface of the cover flap and an aperture in the pouch wall. The separator layer is smaller than the cover flap, but larger than the aperture and is shaped so that the adhesive layer makes asymmetrical contact with the pouch wall around a periphery of the cover flap. Pressure from within the pouch forces a portion of the cover flap having a smaller adhesive contact area to separate from the pouch wall. The valve may also have an intermediate gas permeable layer between the separator layer and the aperture.

Another valve has a cover flap that is disposed across an entire width of a pouch wall. The flap overlays one or more apertures in the pouch wall to allow air to escape from within the pouch and prevent air from entering the pouch.

Yet another valve for a pouch has a patch that is disposed across an entire width of a pouch wall and is sealed to the pouch wall around a periphery of the patch. A first plurality of apertures extending through the pouch wall is offset from a second plurality of apertures extending through the patch. An adhesive is disposed between the first and second pluralities of apertures. Pressure from within the pouch overcomes the adhesive and forces the patch to separate from the pouch wall to allow air to escape from within the pouch.

A still further valve has a patch that is sealed around a periphery of the valve over an inner or outer surface of a plastic tube. The patch may be oriented axially along a length of the tube, or circumferentially around the tube. The patch has a vent opening that is offset from a vent opening through the tube surface. A vent seal zone is defined between the patch and the tube surface. The tube is sealed on both ends such that pressure from within the tube forces the patch to separate from the tube surface to allow air to escape from within the tube.

Yet another valve has first and second zipper flanges sealed to an inside surface of a pouch wall. A line of apertures is disposed through the pouch wall, wherein the first zipper flange is attached to the pouch wall on a first side of the apertures and the second zipper flange is attached to the pouch wall on a second opposite side of the apertures. An air path is formed between the first and second zipper flanges and the apertures. Pressure from within the pouch forces the second flange away from the first flange and pressure from outside the pouch forces the second flange into contact with the first flange. Alternatively, the second flange is eliminated and the pouch wall on the second side of the line of apertures makes contact with the first flange. In another variation, one or more apertures disposed through the first flange are covered in flap fashion by the second flange.

SUMMARY OF THE INVENTION

According to one aspect of the invention, a reclosable pouch having a valve includes opposing sidewalls and first and second opposing layers of a film material disposed across a full width of one of the sidewalls. An overlap region of the second layer overlaps the sidewall, and the first layer is sealed to the second layer around a portion of the second layer. The second layer is sealed to the sidewall around a periphery of the overlap region, and opposing surfaces of the first and second layers form a substantially airtight seal therebetween upon direct contact of the layers. First and second offset apertures extend through the first and second layers, respectively. One of the first and second apertures is in fluid communication with an interior of the pouch and the other of the first and second apertures is in fluid communication with an exterior of the pouch. Vacuum pressure disposed over both of the first and second apertures causes the first layer to separate from the second layer to allow air to exhaust from the pouch.

According to another aspect of the invention, a reclosable pouch having a valve includes opposing sidewalls and first and second opposing layers of a film material disposed across a full width of one of the sidewalls. The entire second layer overlaps the sidewall, and the first layer is sealed to the second layer around a portion of the second layer. The entire second layer is sealed to the sidewall by a thermoplastic weld layer disposed across the full width of the sidewall, and opposing surfaces of the first and second layers form a substantially airtight seal therebetween upon direct contact of the layers. First and second offset apertures extend through the first and second layers, respectively. One of the first and second apertures is in fluid communication with an interior of the pouch and the other of the first and second apertures is in fluid communication with an exterior of the pouch. A seal is disposed between the first and second layers, wherein the seal encloses a region including the first and second offset apertures.

According to yet another aspect of the invention, a reclosable pouch having a valve includes opposing sidewalls and first and second opposing layers of a film material disposed across a full width of one of the sidewalls. An overlap region of the second layer overlaps the sidewall, a region of the second layer does not overlap the sidewall, and the first layer is sealed to the second layer around a portion of the second layer. The second layer is sealed to the sidewall around a periphery of the overlap region, and opposing surfaces of the first and second layers form a substantially airtight seal therebetween upon direct contact of the layers. First and second offset apertures extend through the first and second layers, respectively. One of the first and second apertures is in fluid communication with an interior of the pouch and the other of the first and second apertures is in fluid communication with an exterior of the pouch. Vacuum pressure disposed over both of the first and second apertures causes the first layer to separate from the second layer to allow air to exhaust from the pouch.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

The present invention generally relates to valves for withdrawing a fluid from a container. While the present invention may be embodied in many forms, several embodiments are discussed herein with the understanding that embodiments illustrated are to be considered only as an exemplification of the invention and are not intended to limit the disclosure to the embodiments illustrated. For example, while a reclosable pouch and a reclosable hard-walled container are shown, any other container, such as reclosable or non-reclosable, soft- or hard-walled, to which a valve can be applied to evacuate fluid therefrom can also be used in the present invention.

Figure 1:
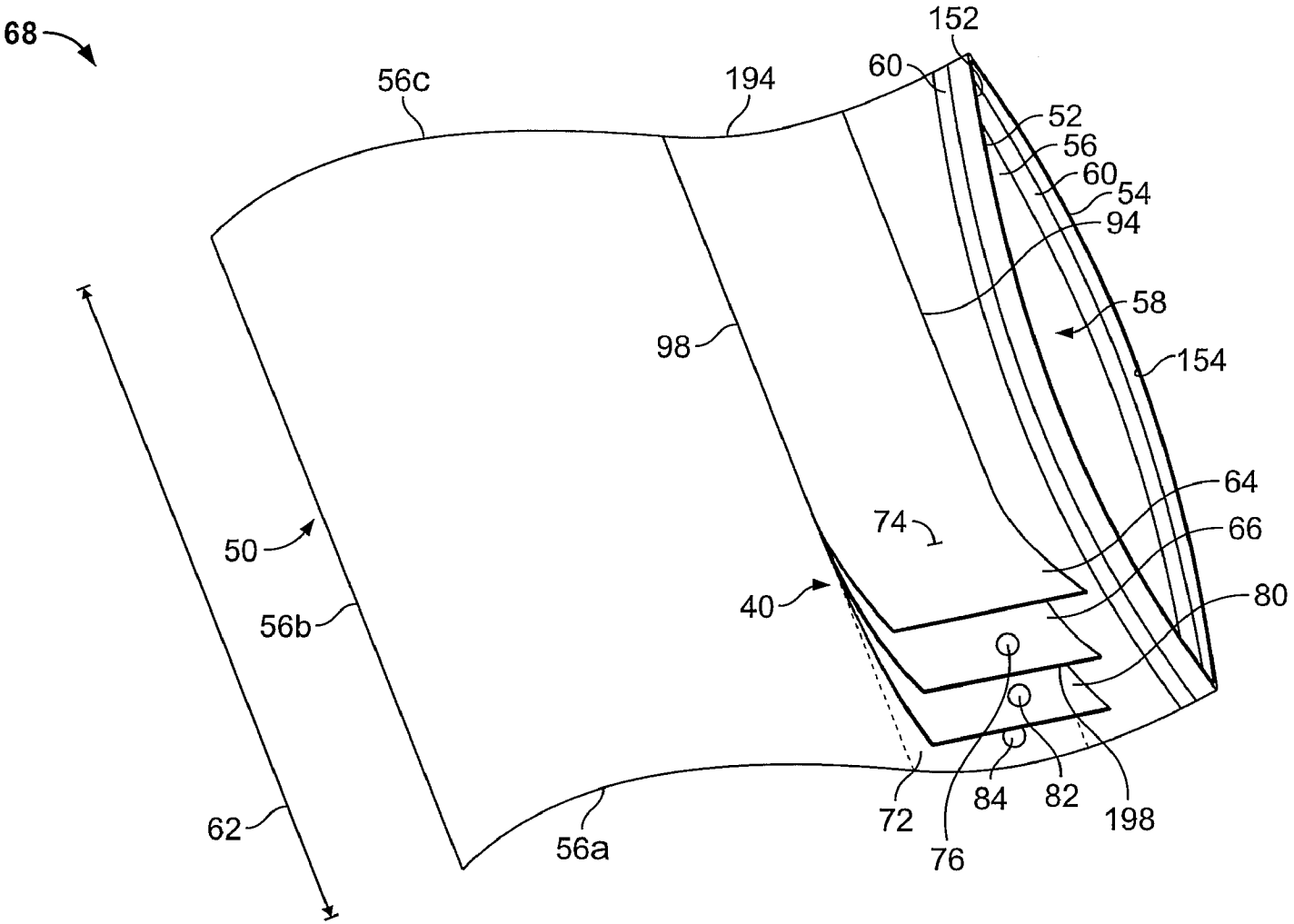
FIG. 1 is an isometric view of a reclosable pouch incorporating a valve and illustrating valve layers peeled up for clarity.

Turning now to the figures, a reclosable thermoplastic pouch 50, illustrated in FIG. 1, includes a first sidewall 52, a second sidewall 54, and a valve 40. The first and second sidewalls 52 and 54 are joined around three side edges 56*a*-56*c* by heat sealing or other sealing method known in the art to define an opening 56 leading to an interior 58. Alternatively, the bottom side 56*b* may be a fold line between the first and second sidewalls 52 and 54. A closure mechanism 60 extends across a full width 62 of the pouch 50 proximate the opening 56. The closure mechanism 60 allows the pouch 50 to be repeatedly opened and closed. When occluded, the closure mechanism 60 provides an air-tight seal such that a vacuum may be maintained in the pouch interior 58 for a desired period of time, such as days, months, or years, when the closure mechanism is sealed fully across the opening 56.

The closure mechanism 60 comprises first and second complementary interlocking closure elements 200, 202 (illustratively shown in FIG. 12) that are attached respectively to the inner surfaces 152 and 154 of the first and second sidewalls 52 and 54. The first interlocking closure element 200 includes one or more interlocking closure profiles 200*a* (illustratively shown in FIG. 12), and the second interlocking closure element 202 also includes one or more interlocking closure profiles 202*a* (illustratively shown in FIG. 12). The first and second interlocking closure profiles 200*a*, 202*a* may be male and female closure profiles, respectively, as shown. However, the configuration and geometry of the interlocking profiles 200*a*, 202*a* or closure elements 200, 202 disclosed herein may vary.

In a further embodiment, one or both of the first and second complementary interlocking closure elements 200, 202 may include one or more textured portions, such as a bump or crosswise groove in one or more of the first and second closure profiles 200*a*, 202*a* in order to provide a tactile sensation, such as a series of clicks, as a user draws the fingers along the closure mechanism 60 to seal the closure elements across the opening. In another embodiment, the first and second interlocking closure profiles 200*a*, 202*a* include textured portions along the length of each profile to provide tactile and/or audible sensations when closing the closure mechanism 60. In addition, protuberances, for example ridges (not shown), may be disposed on the inner surfaces 152, 154 of the respective first and second sidewalls 52, 54 proximate the opening 56 to provide increased traction in a convenient area for a user to grip, such as a gripping flange, when trying to open the sealed pouch 50.

Further, in some embodiments, a sealing material such as a polyolefin material or a caulking composition such as silicone grease may be disposed on or in the interlocking profiles 200*a*, 202*a* or closure elements 200, 202 to fill in any gaps or spaces therein when occluded. The ends of the interlocking profiles 200*a*, 202*a* or closure elements 200, 202 may also be welded or sealed by ultrasonic vibrations as is known in the art. Illustrative interlocking profiles, closure elements, sealing materials, tactile or audible closure elements, and/or end seals useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S. Patent Application Publication No. 2006/0048483, and Anzini et al. U.S. Patent Application Publication Nos. 2006/0093242 and 2006/0111226. Other interlocking profiles and closure elements useful in the present invention include those disclosed in, for example, U.S. patent application Ser. No. 11/725,120, filed Mar. 16, 2007, and (U.S. patent application Nos. to be assigned), each filed on the same day as the present application. It is further appreciated that the interlocking profiles or closure elements disclosed herein may be operated by hand, or a slider (not shown) may be used to assist in occluding and de-occluding the interlocking profiles and closure elements.

The resealable pouch described herein can be made by various techniques known to those skilled in the art including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

A first layer 64 of a film material is disposed across the full width 62 of the first sidewall 52. A second layer 66 of film material is also disposed across the full width 62 of the first sidewall 52 between the first sidewall and the first layer 64. Each of the first and second layers 64 and 66 may be comprised of one or more plies of material. An exterior 68 of the pouch 50 is also shown in FIG. 1.

Figure 2:
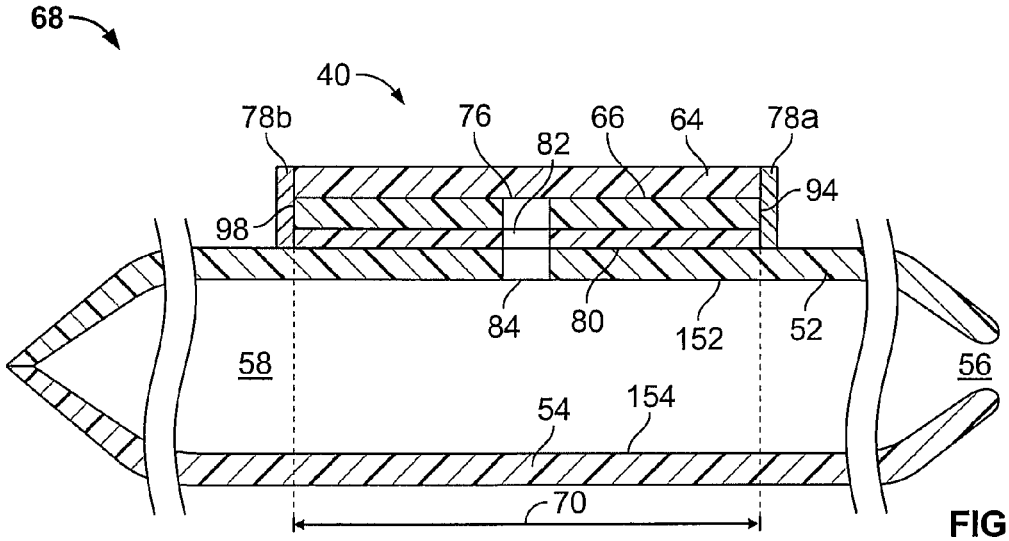
FIG. 2 is a fragmentary cross-sectional view of an embodiment of a valve taken generally along the lines 2-2 of FIG. 1A with portions behind the plane of the cross-section omitted for clarity.

Referring next to an embodiment of the valve 40 as seen in FIG. 2, the second layer 66 has an overlap region 70 that overlaps the first sidewall 52. The overlap region 70 comprises the entire second layer 66. A projection 72 of the overlap region 70 of the second layer 66 is shown by the area outlined by the dashed lines in FIG. 1.

Figure 6:
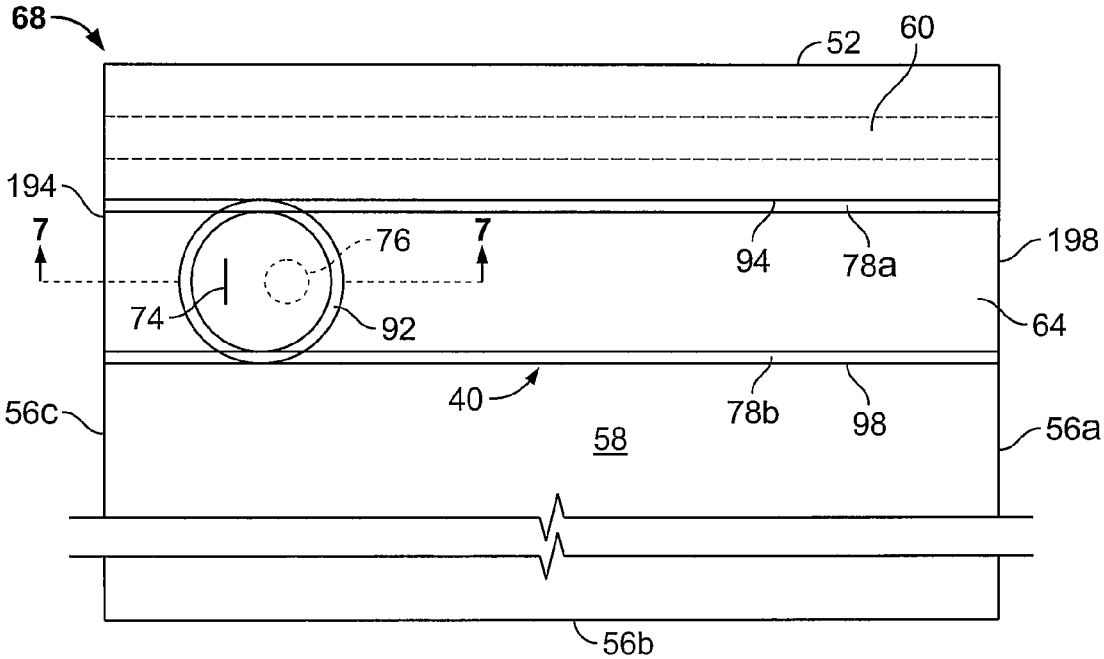
FIG. 6 is a fragmentary plan view of a first sidewall of a pouch illustrating a further embodiment of a valve.
Figure 6A:
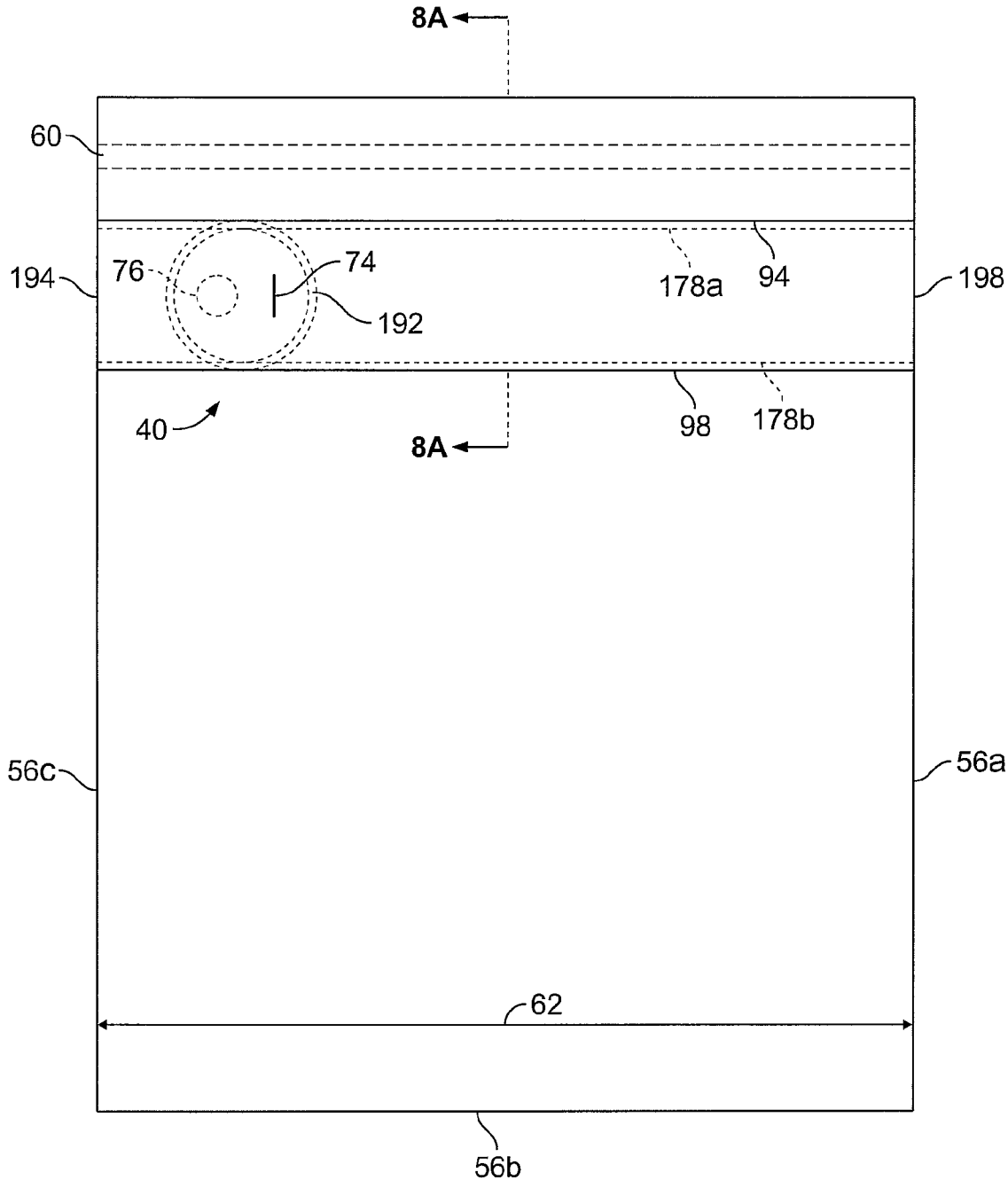
FIG. 6A is a plan view of a first sidewall of a pouch illustrating a still further embodiment of a valve.

Referring now to FIGS. 1 and 2, a first aperture 74 extends through the first layer 64 and a second aperture 76 extends through the second layer 66. The first layer 64 is attached to the second layer 66 at a portion of the second layer. Illustratively, the first layer 64 is attached to the second layer 66 around the entire periphery of the second layer, or along the full width 62 of the second layer, or along one or more peripheral edges 94, 98, 194, 198 of the second layer. The first and second layers 64 and 66 are attached to each other by a seal 78*a* along the peripheral edge 94 and by a seal 78*b* along the peripheral edge 98. Each of the seals 78*a*, 78*b* may be a heat seal or some other sealing method known in the art. The seals 78*s*, 78*b* may be continuous as shown in FIG. 6, or may be intermittent spot seals 178*a*, 178*b* as shown in FIG. 6A. The second layer 66 is sealed to the first sidewall 52 at a periphery of the overlap region 70 of the second layer 66, including for example, around a periphery of the overlap region or on at least a portion of the overlap region. In the first embodiment of FIG. 2, a thermoplastic weld layer 80 is disposed across the full width 62 of the first sidewall 52 between the sidewall 52 and the second layer 66 to seal the entire second layer 66 to the first sidewall 52. The thermoplastic weld layer 80 may be composed of any suitable thermoplastic material, such as for example, polypropylene.

A third aperture 82 extends through the thermoplastic weld layer 80 and a fourth aperture 84 extends through the first sidewall 52. The second, third, and fourth apertures, 76, 82, and 84 are arranged to be coincident along a line perpendicular to the sidewall 52, to allow fluid communication of the second aperture 76 with the interior 58 of the pouch 50. The first aperture 74 in the first layer 64 is in fluid communication with the exterior 68 of the pouch 50.

Figure 1A:
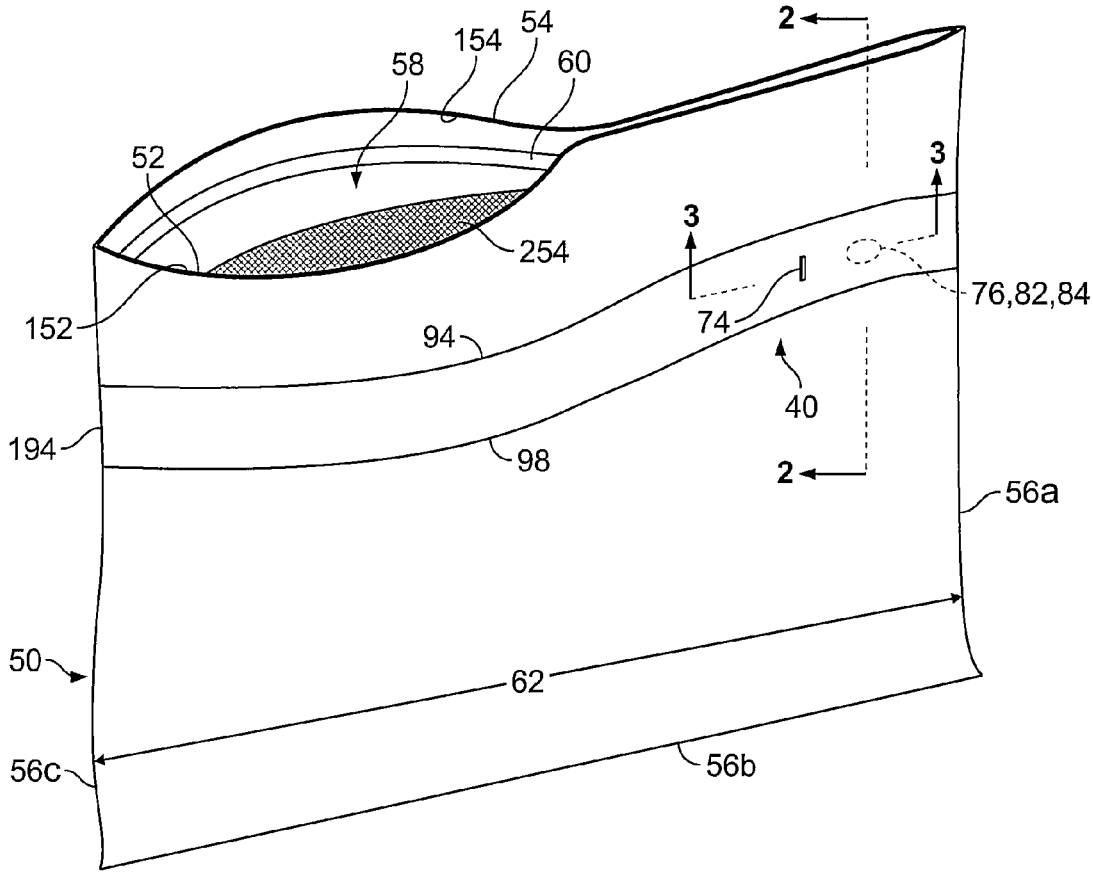
FIG. 1A is an isometric view of a reclosable pouch illustrating a textured pattern on a sidewall.

One or both sidewalls, such as the second sidewall 54, may also be embossed or otherwise textured with a pattern 254. One or both surfaces of the second sidewall 54, for example the inner surface 154, may be embossed or textured between the bottom side edge 56*b* and the closure mechanism 60, or a separate textured or embossed patterned wall may be used to provide flow channels (not shown) within the pouch interior 58. In one embodiment, the second sidewall 54 is embossed with a diamond pattern 254 as shown in FIG. 1A, wherein the pattern extends from just beneath the closure mechanism 60 to the bottom side edge 56*b* and opposes the second aperture 76 that is in fluid communication with the interior 58 of the pouch 50. The flow channels may provide fluid communication between the pouch interior 58 and the valve 40 when fluid is being drawn through the valve 40. Illustrative flow channels useful in the present invention include those disclosed in Zimmerman et al. U.S. Patent application publication No. 2005/0286808 and Tilman et al. U.S. Patent application publication No 2006/0048483. Other flow channels useful in the present invention include those disclosed in, for example, (U.S. patent application No. to be assigned), filed on the same day as the present application.

Figure 3:
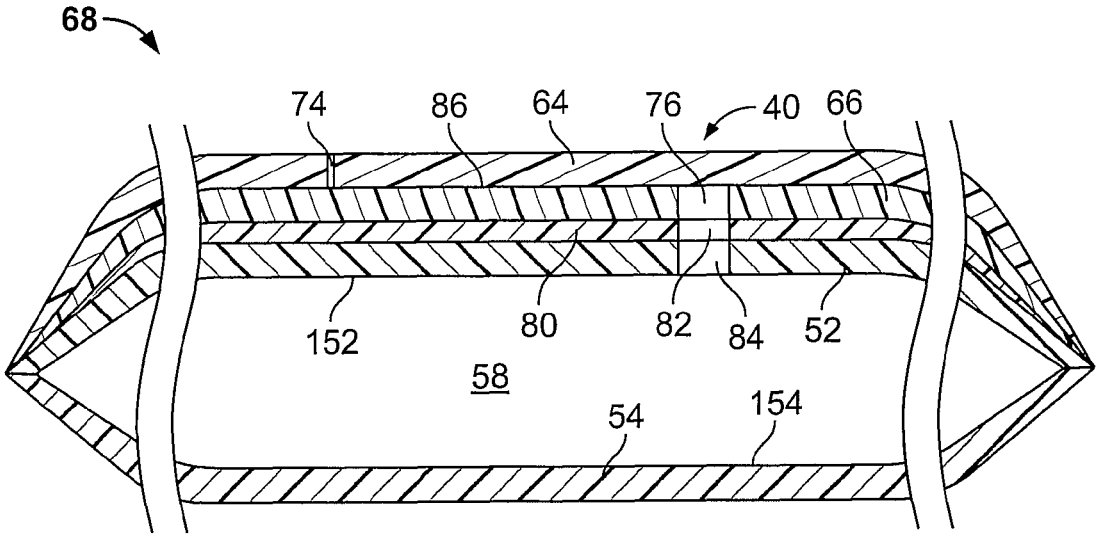
FIG. 3 is a fragmentary cross-sectional view taken generally along the lines 3-3 of FIG. 1A with portions behind the plane of the cross-section omitted for clarity.

Referring next to FIG. 3, the first aperture 74 is offset from the second, third, and fourth apertures 76, 82, and 84. The first and second layers 64 and 66 are in direct contact in an intermediate seal region 86 between the offset first and second apertures 74 and 76. Although the first and second apertures 74 and 76 are shown in FIG. 3 to be offset from one another along the width 62 of the pouch 50, in all of the embodiments described herein the first and second apertures may be offset in any relative orientation that allows for direct contact of the first and second layers 64 and 66 in the intermediate seal region 86 between the first and second apertures. A substantially airtight seal is formed between the first and second layers 64 and 66 by direct contact of the first layer to the second layer.

In one embodiment, the first and second sidewalls 52, 54 and/or the closure mechanism 60 are formed from thermoplastic resins by known extrusion methods. For example, the sidewalls 52, 54 may be independently extruded of thermoplastic material as a single continuous or multi-ply web, and the closure mechanism 60 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, the inner surfaces 152, 154 of the respective sidewalls 52, 54 or a portion or area thereof may, for example, be composed of a polyolefin plastomer such as an AFFINITY™ resin manufactured by Dow Plastics. Such portions or areas include, for example, the area of one or both of the sidewalls 52, 54 proximate and parallel to the closure mechanism 60 to provide an additional cohesive seal between the sidewalls 52, 54 when the pouch 50 is evacuated. One or more of the sidewalls 52, 54 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 52, 54. The barrier layer may be, for example, adhesively secured between the PP and/or LDPE plies to provide a multilayer film. Other additives such as colorants, slip agents, and antioxidants, including for example talc, oleamide or hydroxyl hydrocinnamate may also be added as desired. In another embodiment, the closure mechanism 60 may be extruded primarily of molten PE with various amounts of slip component, colorant, and/or talc additives in a separate process. The fully formed closure mechanism 60 may be attached to the pouch body using a strip of molten thermoplastic weld material, or by an adhesive known by those skilled in the art, for example. Other thermoplastic resins and air-impermeable films useful in the present invention include those disclosed in, for example, Tilman et al. U.S. Patent application publication No 2006/0048483.

Figure 4:
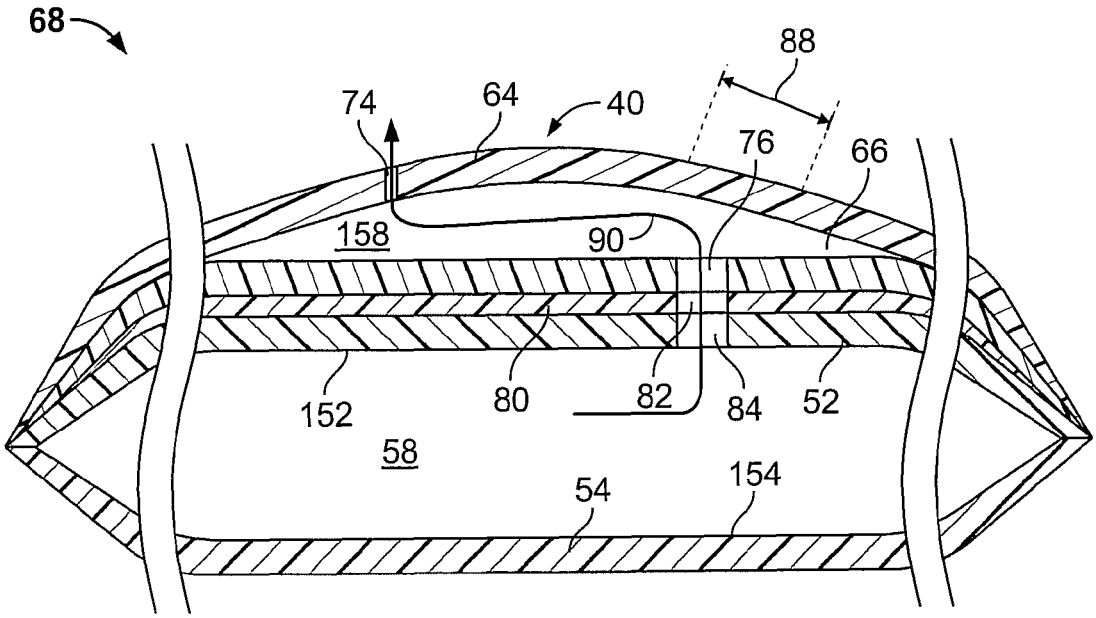
FIG. 4 is a fragmentary cross-sectional view taken generally along the lines 3-3 of FIG. 1A with first and second layers of the valve of the first embodiment separated and with portions behind the plane of the cross-section omitted for clarity.

With reference to FIG. 4, and not wishing to be bound by theory, the operation of the embodiment of FIGS. 2 and 3 will now be described, it being believed that the other embodiments discussed herein operate in a similar fashion. Fluid pressure from the exterior 68 of the pouch 50 that is greater than or equal to a fluid pressure of the interior 58 of the pouch compresses the pouch and forces the first and second layers 64 and 66 into contact with each other, thereby forming a seal. Further, an opening region 88 of the first layer 64 disposed directly over the second aperture 76, is subject to any pressure imbalance between the interior and exterior 58 and 68 of the pouch 50. Increased fluid pressure from the interior 58 of the pouch 50 forces the opening region 88 of the first layer 64 away from the second layer 66 and thereafter a remainder of the first layer is forced away from the second layer. Separation of the opening region 88 from the second aperture 76 allows higher pressure fluid from within the interior 58 of the pouch 50 to spread away from the second aperture into a space 158 formed between the layers 64 and 66. An expanding zone of higher pressure fluid applies a pressure imbalance to a corresponding expanding region of the first layer 64. When the expanding zone of higher pressure fluid reaches the first aperture 74, the higher pressure fluid escapes through the first aperture to the exterior 68 of the pouch 50. At this point, fluid can escape freely from the interior 58 of the pouch 50 to the exterior 68 of the pouch following a path 90 as depicted by the curved line and arrow in FIG. 4.

The valve 40 provides a fluid path with direct fluid communication between the interior 58 and the exterior 68 of the pouch. Although not shown, in some embodiments a second valve may be disposed in or through the closure mechanism 60 or in one of the side edges 56*a*-56*c* of the pouch. Illustrative second valves useful in the present invention include those disclosed in, for example, Newrones et al. U.S. Patent application publication No. 2006/0228057. Other valves useful in the present invention include those disclosed in, for example, (U.S. patent application Nos. to be assigned), each filed on the same day as the present application.

In use, application of vacuum pressure over the exterior of the first and second apertures 74 and 76 causes the interior 58 of the pouch below the first and second apertures to have a greater pressure than the exterior. Vacuum pressure may be applied by an evacuation pump or device or any other source of vacuum pressure known in the art, for example, by placing a vacuum cup of the evacuation pump in contact with an outer surface of the pouch and drawing a vacuum on an interior of the vacuum cup, thereby creating an expansive pressure imbalance and holding down the first and second layers 64 and 66 around the pressure imbalance. Illustrative evacuation pumps or devices useful in the present invention include those disclosed in, for example, (U.S. patent application No. to be assigned), filed on the same day as the present application.

Although not shown, a porous or adhesive layer disposed between one or more of the valve layers 64, 66 may also be desired in any of the embodiments disclosed herein. Examples of adhesives useful in the present invention include those described in, for example, Hamilton U.S. Pat. No. 7,004,632 or Mizuno U.S. Pat. No. 5,989,608. Examples of a porous material useful in the present invention include those described in, for example, Mizuno U.S. Pat. No. 5,989,608 or Shah et al. U.S. Patent Application Publication No. 2004/0223667.

Figure 5:
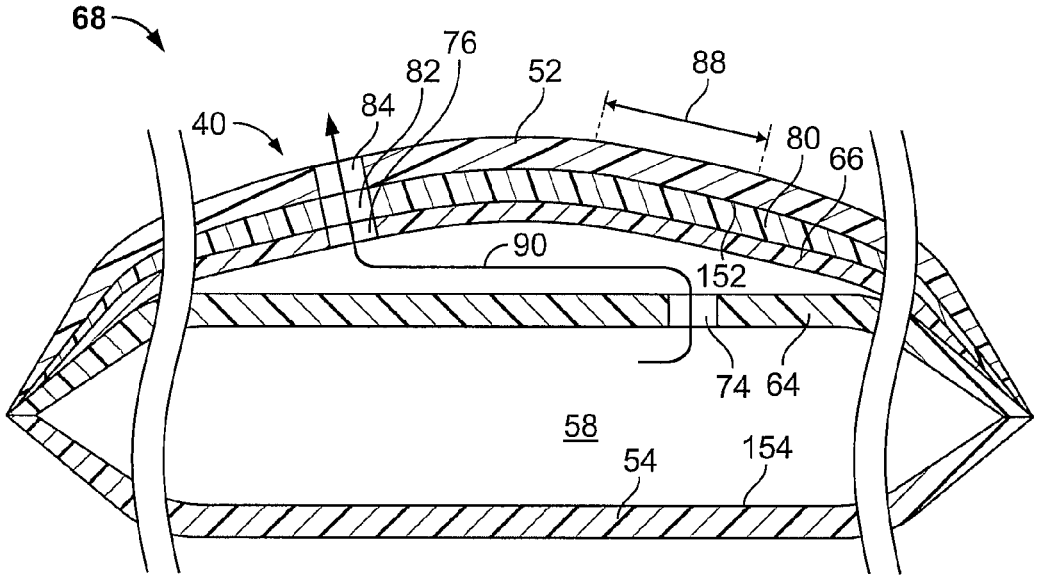
FIG. 5 is a fragmentary cross-sectional view of another embodiment of a valve taken generally along the lines 3-3 of FIG. 1A with first and second layers thereof separated and with portions behind the plane of the cross-section omitted for clarity.

In another embodiment depicted in FIG. 5, the first and second layers 64 and 66 and the thermoplastic weld layer 80 are disposed on the interior 58 of the pouch 50. In this embodiment, the opening region 88 of the second layer 66 is disposed directly over the first aperture 74 disposed in the first layer 64. In all of the embodiments described herein, either the first aperture 74 or the second aperture 76 may be in fluid communication with the exterior 68 of the pouch 50 or, for example, may be covered by an additional layer (not shown) to protect or hide the aperture 74 or 76. The aperture 74 or 76 that is in fluid communication with the exterior 68 of the pouch 50 may be a slit or a hole or opening of any cross-section, for example, circular, square-shaped, triangular, rectangular, pentagonal, or any other suitable shape.

Figure 7:
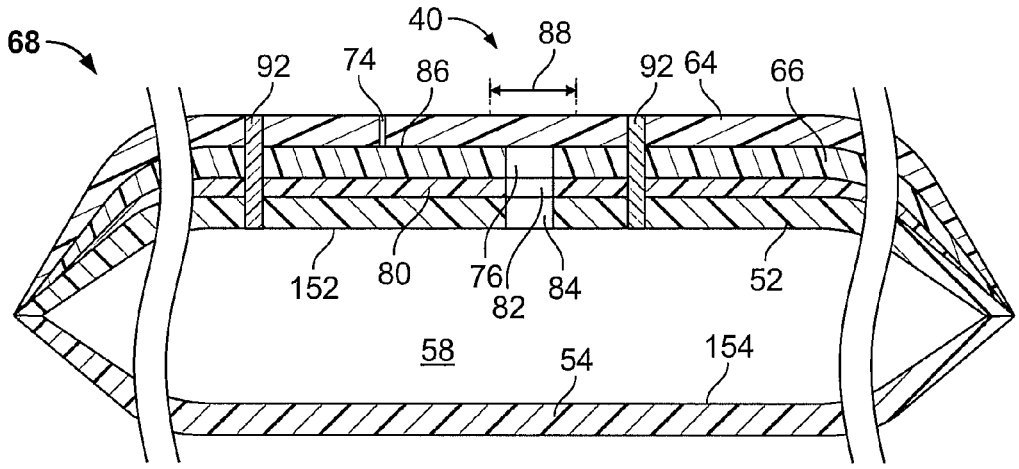
FIG. 7 is a fragmentary cross-sectional view taken generally along the lines 7-7 of FIG. 6 with portions behind the plane of the cross-section omitted for clarity.

Referring next to FIGS. 6 and 7, in a further embodiment, the first and second layers 64 and 66, the thermoplastic weld layer 80, and the first sidewall 52 are further attached together by a surrounding seal 92. The surrounding seal 92 may be a continuous seal as shown in FIG. 6, or may be an intermittent spot seal 192 as shown in FIG. 6A. The surrounding seal 92 may optionally be disposed between only the first and second layers 64 and 66. The surrounding seal 92 surrounds the first aperture 74 and the second aperture 76. The surrounding seal 92 may be a heat seal or may be formed by any sealing method known in the art. Although shown as a circular seal in FIGS. 6 and 6A, the surrounding seal 92 may have any shape, for example, triangular, elliptical, square-shaped, pentagonal, hexagonal, etc. Additionally, although the individual sealing spots that comprise the intermittent spot seals 178*a*, 178*b*, and 192 are shown in FIG. 6A to be generally circular, the individual sealing spots may be, for example, circular, elliptical, square-shaped, triangular, rectangular, pentagonal, hexagonal, or any other convenient shape. Alternatively, the first and second layers 64 and 66 and the surrounding seal 92 may be disposed on the interior 58 of pouch 50.

Figure 8:
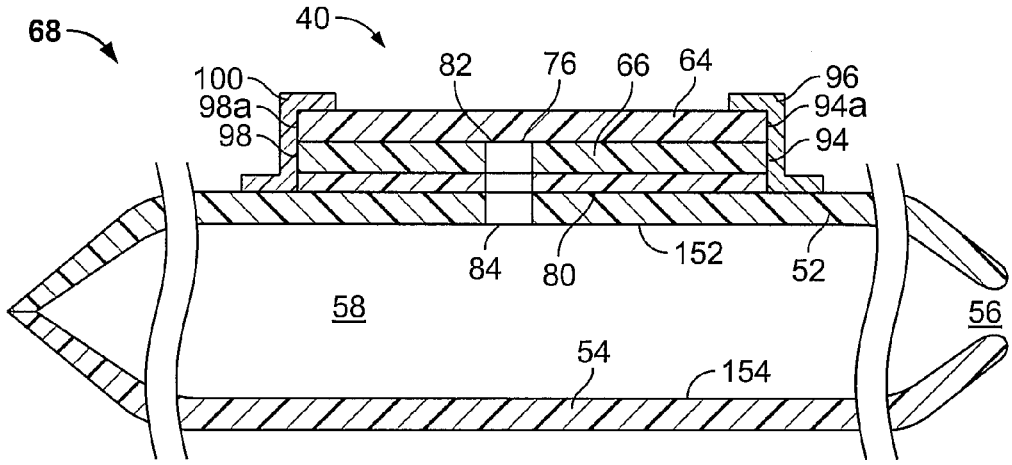
FIG. 8 is a fragmentary cross-sectional view taken generally along the lines 2-2 of FIG. 1A and illustrating yet another embodiment of a valve with portions behind the plane of the cross-section omitted for clarity.
Figure 8A:
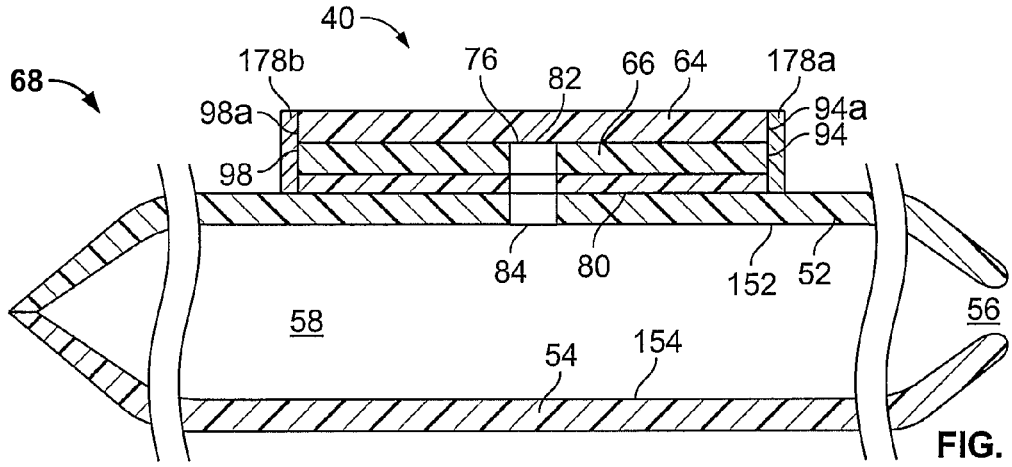
FIG. 8A is a fragmentary cross-sectional view taken generally along the lines 8A-8A of FIG. 6A and illustrating another embodiment of a valve with portions behind the plane of the cross-section omitted for clarity.

In yet another embodiment, as seen in FIG. 8, first edges 94*a* and 94 of the first and second layers 64 and 66, respectively, are attached to the first sidewall 52 by a first edge thermoplastic weld layer 96, and second edges 98*a* and 98 of the first and second layers 64 and 66, respectively, are attached to the first sidewall 52 by a second edge thermoplastic weld layer 100. Alternatively, as seen in FIG. 8A, the first edges 94*a* and 94 of the first and second layers 64 and 66, respectively, are attached to the first sidewall 52 by the intermittent spot seal 178*a*, and the second edges 98*a* and 98 of the first and second layers 64 and 66, respectively, are attached to the first sidewall 52 by the intermittent spot seal 178*b*. The first and second edge thermoplastic weld layers 96,100 and the intermittent spot seals 178*a*, 178*b* are disposed across the full width 62 (FIG. 1) of the first sidewall 52. The first and second layers 64 and 66 and the first and second edge thermoplastic weld layers 96, 100 or the intermittent spot seals 178*a*, 178*b* may alternatively be disposed on the interior 58 of the pouch 50.

Figure 9:
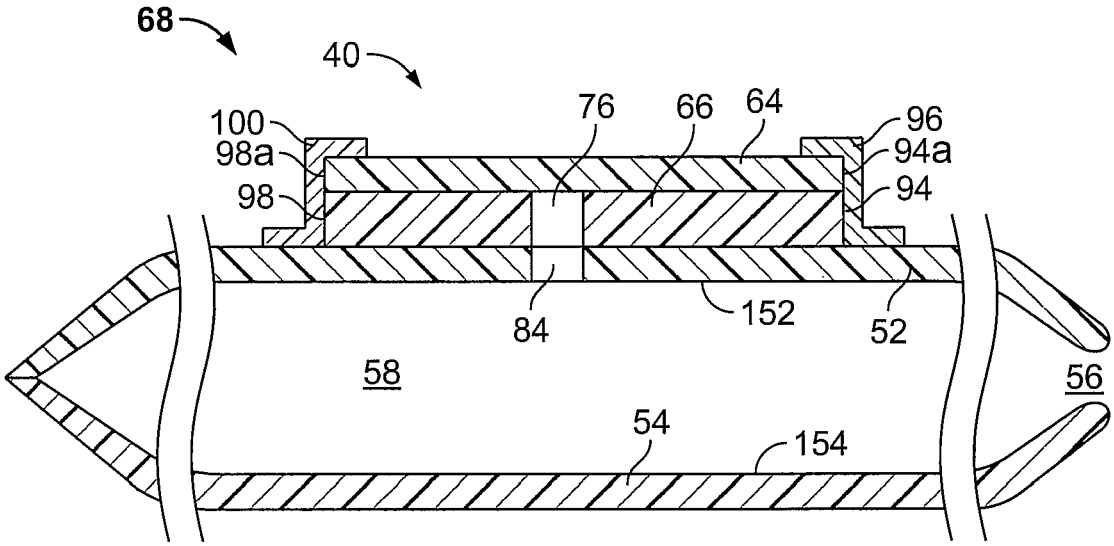
FIG. 9 is a fragmentary cross-sectional view taken generally along the lines 2-2 of FIG. 1A and illustrating a still further embodiment of a valve with portions behind the plane of the cross-section omitted for clarity.
Figure 9A:
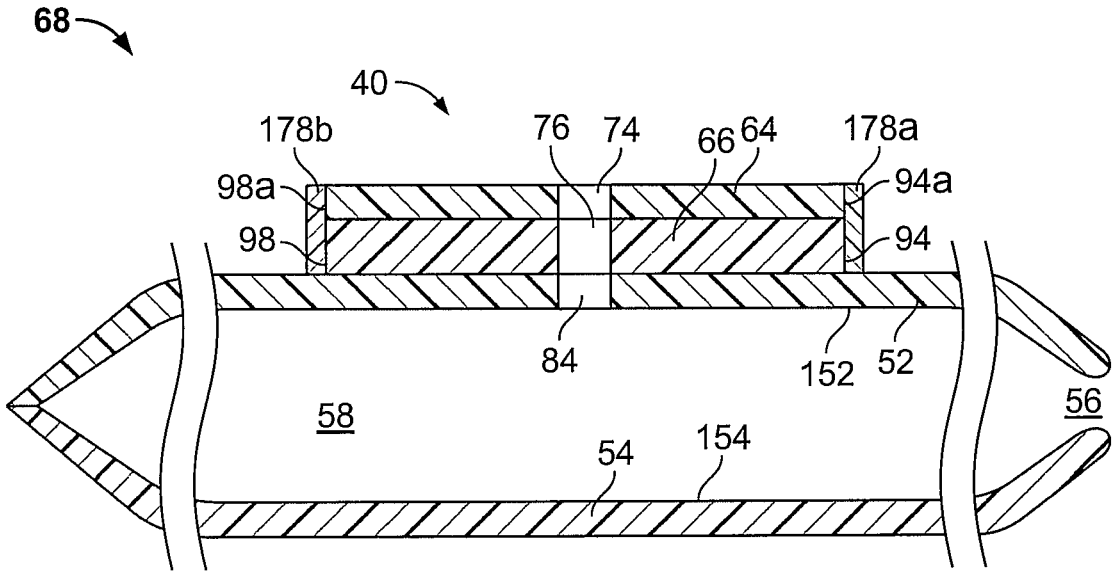
FIG. 9A is a fragmentary cross-sectional view taken generally along the lines 9A-9A of FIG. 6A and illustrating another embodiment of a valve with portions behind the plane of the cross-section omitted for clarity.

A still further embodiment is depicted in FIG. 9, wherein the entire second layer 66 is sealed directly to the first sidewall 52. The first edge 94*a* of the first layer 64 is attached to the first sidewall 52 by the first edge thermoplastic weld layer 96, and the second edge 98*a* of the first layer 64 is attached to the first sidewall 52 by the second edge thermoplastic weld layer 100. Alternatively, the first edge 94*a* of the first layer 64 is attached to the first sidewall 52 by the intermittent spot seal 178*a*, and the second edge 98*a* of the first layer 64 is attached to the first sidewall 52 by the intermittent spot seal 178*b*. The first and second layers 64 and 66 and the first and second edge thermoplastic weld layers 96, 100 or the intermittent spot seals 178*a*, 178*b* may alternatively be disposed on the interior 58 of the pouch 50.

Figure 10:
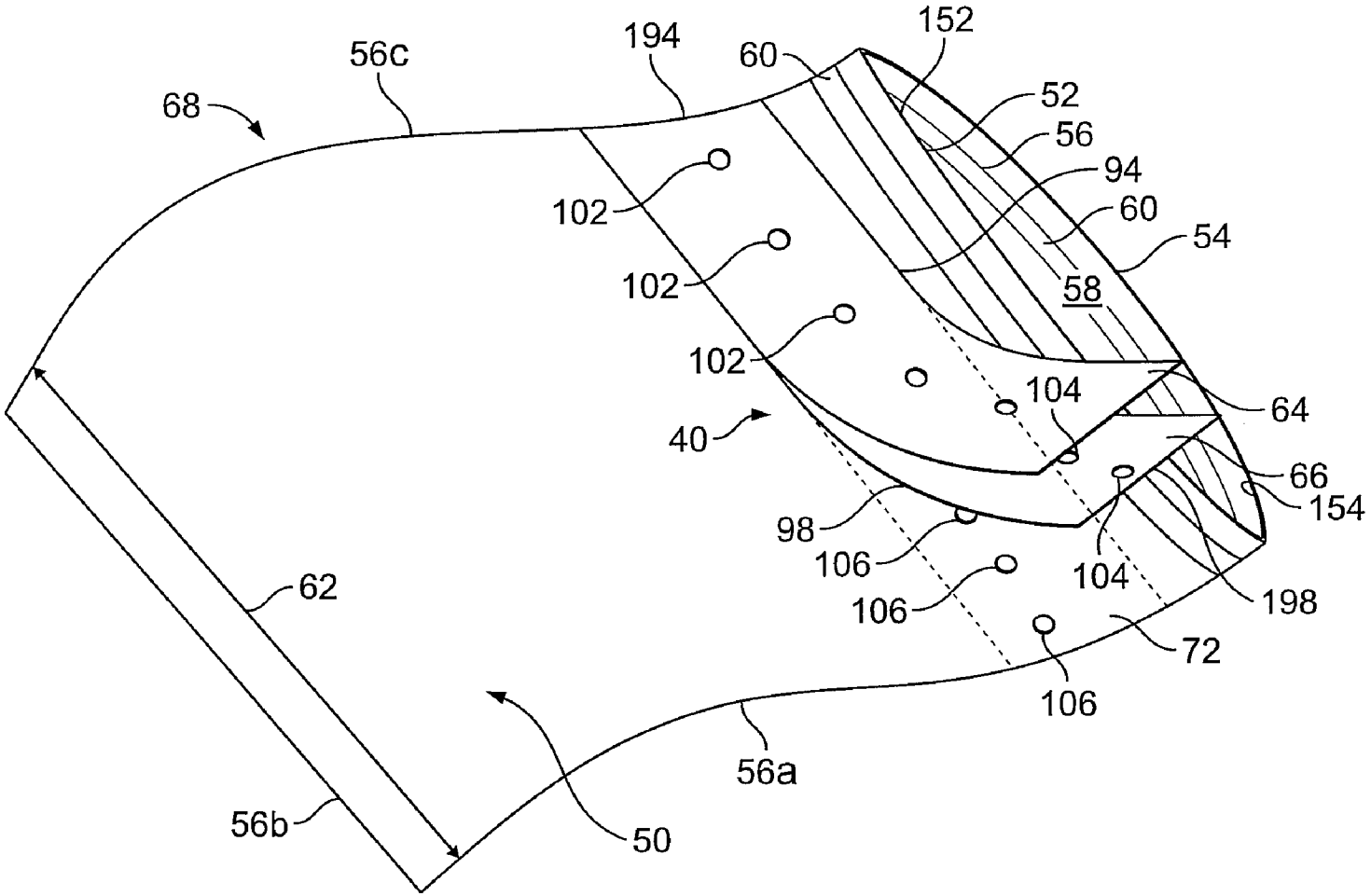
FIG. 10 is an isometric view of the reclosable pouch illustrating still another embodiment of a valve with valve layers peeled up for clarity.

Referring next to FIG. 10, in still another embodiment, a first plurality of apertures 102 extends through the first layer 64. A second plurality of apertures 104 extends through the second layer 66, wherein the second plurality of apertures 104 is offset from the first plurality of apertures 102. A third plurality of apertures 106 extends through the first sidewall 52 of the pouch 50. The second and third pluralities of apertures 104 and 106 are arranged to be coincident along a line perpendicular to the first sidewall 52, thereby allowing fluid communication of the second plurality of apertures 104 with the interior 58 of the pouch 50. Alternatively, the first and second layers 64 and 66 that have the first and second pluralities of apertures 102 and 104 respectively extending therethrough may be disposed on the interior 58 of the pouch 50.

Figure 11:
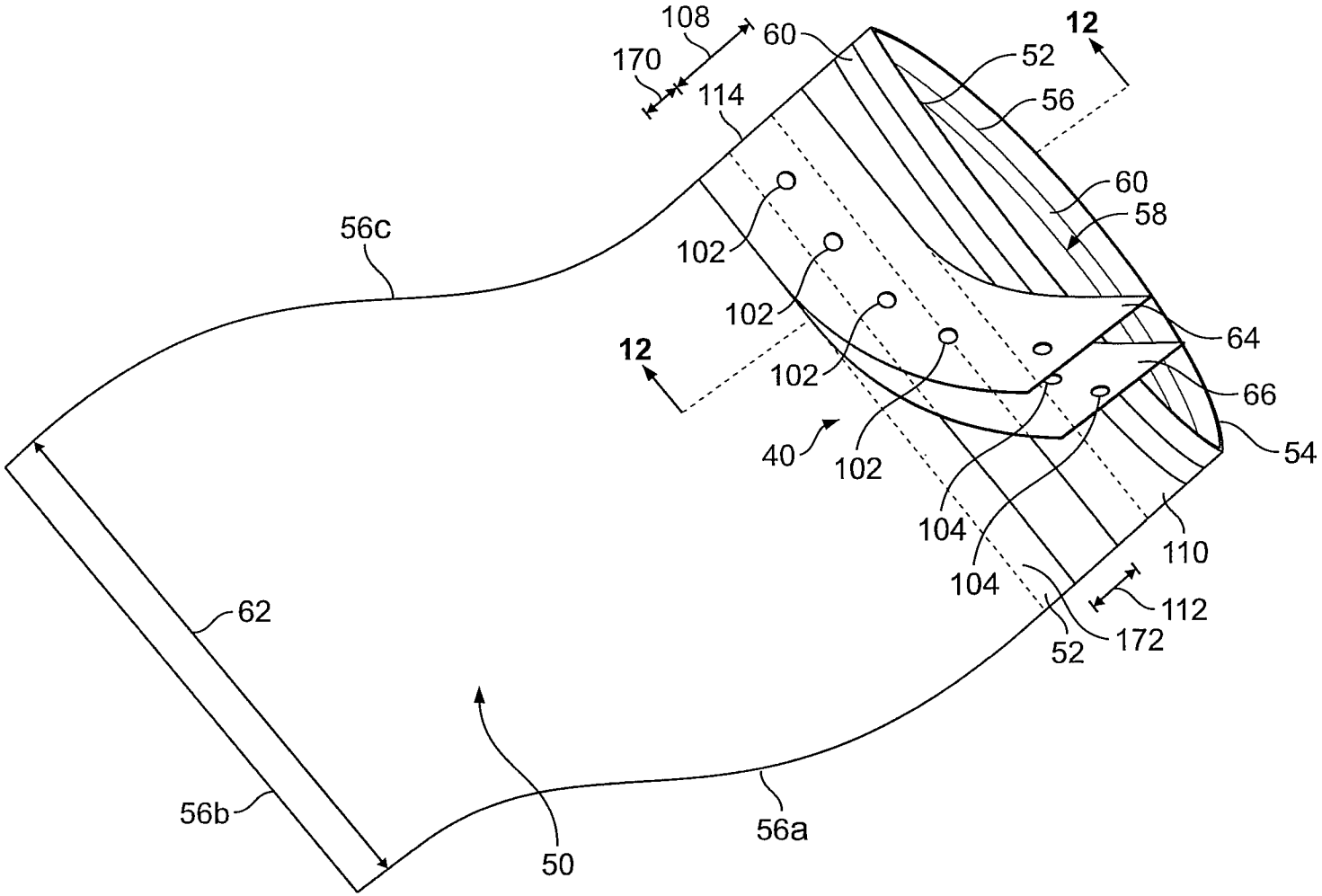
FIG. 11 is a an isometric view of the reclosable pouch illustrating a yet further embodiment of a valve with valve layers peeled up for clarity.
Figure 12:
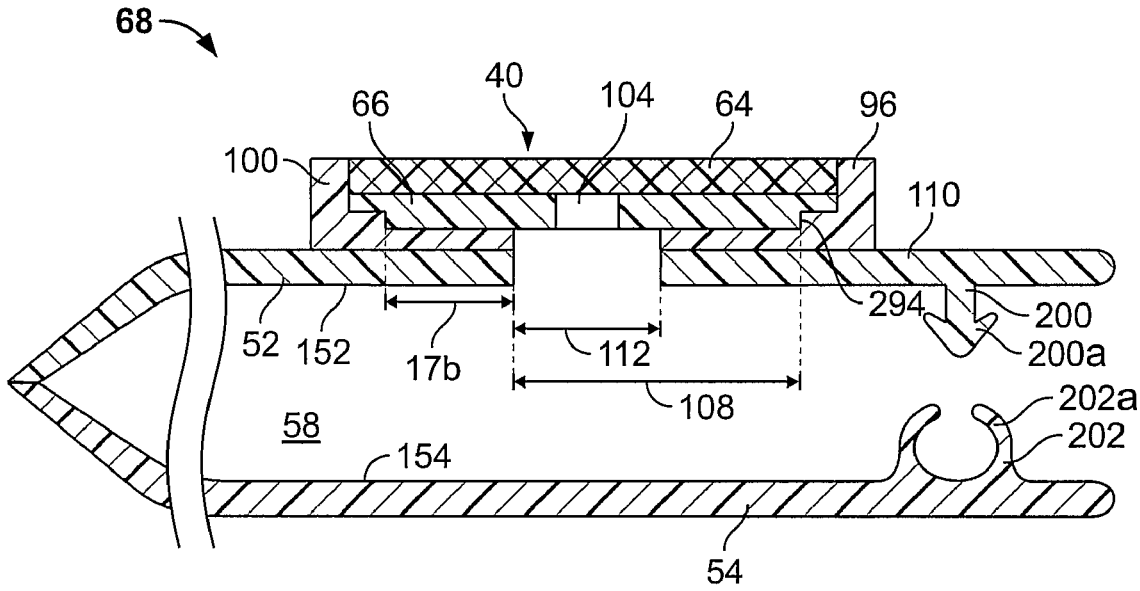
FIG. 12 is a fragmentary cross-sectional view taken generally along the lines 12-12 of FIG. 11 with portions behind the plane of the cross-section omitted for clarity.

In a yet further embodiment, as seen in FIGS. 11 and 12, the second layer 66 includes an overlap region 170 that overlaps the first sidewall 52 and a portion 108 that does not overlap with the first sidewall. The projection 172 of the overlap region 170 of the second layer 66 is shown by the area outlined by the dashed line in FIG. 11. An edge 294 of the second layer 66 is joined to a closure flange 110 that may have a first closure element 200 disposed thereon, leaving a gap 112 across the full width 62 of the pouch 50 between the first sidewall 52 and the closure flange. A second closure element 202 may also be disposed on the second sidewall 54 opposing the first closure element 200. The closure elements 200 and 202 may be any type of complementary interlocking closure elements known in the art, as previously described herein. The second plurality of apertures 104 is in fluid communication with the interior 58 of the pouch 50 through the gap 112. The gap 112 is sealed along first and second ends 114 and 116 between the second layer 66 and the second sidewall 54. The first and second edge thermoplastic weld layers 96 and 100 extend partially under the second layer 66 to attach the first and second layers 64 and 66 together and attach the first and second layers to the first sidewall 52 and the closure flange 110, respectively. In place of the thermoplastic weld layers 96, 100, the intermittent spot seals 178*a*, 178*b* may attach the first and second layers 64 and 66 together and attach the first and second layers to the first sidewall 52 and the closure flange 110, respectively. Alternatively, the first and second layers 64 and 66 and the first and second edge thermoplastic weld layers 96, 100 or the intermittent spot seals 178*a*, 178*b* may be disposed on the interior 58 of the pouch 50.

The first and second layers 64 and 66 of any of the valves 40 as disclosed herein may be independently composed of any thermoplastic material such as would be used for the first and second sidewalls 52 and 54 of the pouch 50 as described herein. Each of the first and second layers 64 and 66 may be composed of the same material as the other layer or could be independently composed of different material than the other layer. In addition, each of the first and second layers 64 and 66 may also have multiple plies, each ply being independently composed of any thermoplastic material such as would be used for the first and second sidewalls 52 and 54 of the pouch 50 as described herein, or a blend of any thermoplastic material such as would be used for the first and second sidewalls of the pouch as described herein. Illustratively, the first and second layers 64 and 66 may, for example, be composed of a polyolefin plastomer such as an AFFINITY™ resin manufactured by Dow Plastics.

Figure 13:
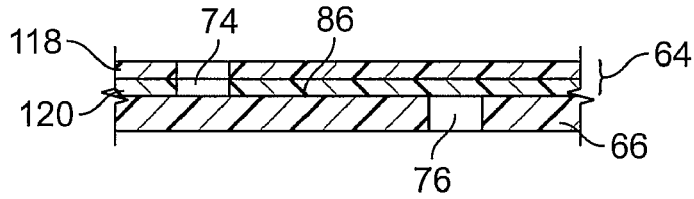
FIG. 13 is a partial cross-sectional view depicting layers and plies for a valve and taken generally along the lines 3-3 of FIG. 1A, with portions behind the plane of the cross-section omitted for clarity.
Figure 14:
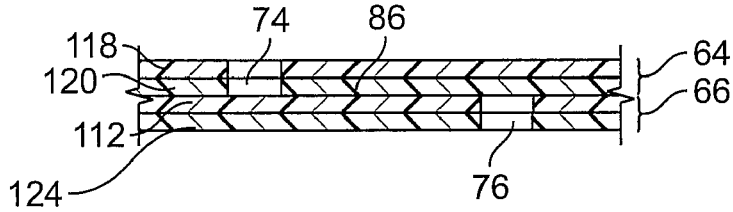
FIGS. 14 and 15 are partial cross-sectional views similar to that of FIG. 13 illustrating alternative constructions of layers and plies for valves herein.
Figure 15:
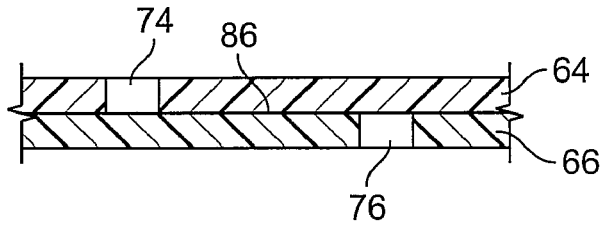

FIGS. 13-15 depict various illustrative embodiments for the first and second layers 64 and 66. Referring to FIG. 13, the first layer 64 is composed of a first ply 118 and a second ply 120. Although any suitable flexible thermoplastic materials may be used for the first and second plies 118 and 120, in this embodiment, for example, the first ply 118 is composed of polypropylene or HDPE and the second ply 120 is composed of a polyolefin plastomer. The second layer 66 in FIG. 13 includes a single ply and may be made of any suitable flexible thermoplastic, but illustratively the second layer 66 is made of polypropylene, HDPE, polyolefin plastomer, or a blend of any two or all three of polypropylene, HDPE, and polyolefin plastomer. The structures of the first and second layers 64 and 66 may also be reversed such that the first layer 64 has a single ply and the second layer 66 has two plies. Other additives known to those skilled in the art may also be included in the composition of the first and second layers 64 and 66, as desired such as to improve handling and manufacturing characteristics.

As seen in FIG. 14, the first layer is substantially identical to that of FIG. 13 and the second layer 66 is composed of a first ply 122 and a second ply 124. Although any suitable flexible thermoplastic materials may be used for the first and second plies 122 and 124 of the second layer 66, in this embodiment, for example, the first ply 122 is composed of a polyolefin plastomer and the second ply 124 is composed of polypropylene or HDPE.

Referring next to FIG. 15, the first and second layers 64 and 66 are both composed of a single ply of material. Although any suitable flexible thermoplastic materials may be used for the first and second layers 64 and 66, illustrative materials are polyolefin plastomer, polypropylene, HDPE, or a blend of any two or all three of polypropylene, HDPE, and polyolefin plastomer.

Although not shown, it is also contemplated that one or more of the valves 40 or valve layers, for example, the first or second layers 64 or 66, may extend along a portion of the width 62 of the pouch 50. For example, one or more of the valve layers may extend only along a portion of the pouch 50 proximate one side edge of the pouch, or may be disposed away from the side edges of the pouch toward the center of the pouch, or may be offset from the center of the pouch. However, by extending the valve 40 across the entire width 62 of the pouch 50 it is contemplated that the complexity of manufacturing the valve and/or pouch may be reduced because the first and second layers 64 and 66 may be applied in a continuous process.

Figure 16:
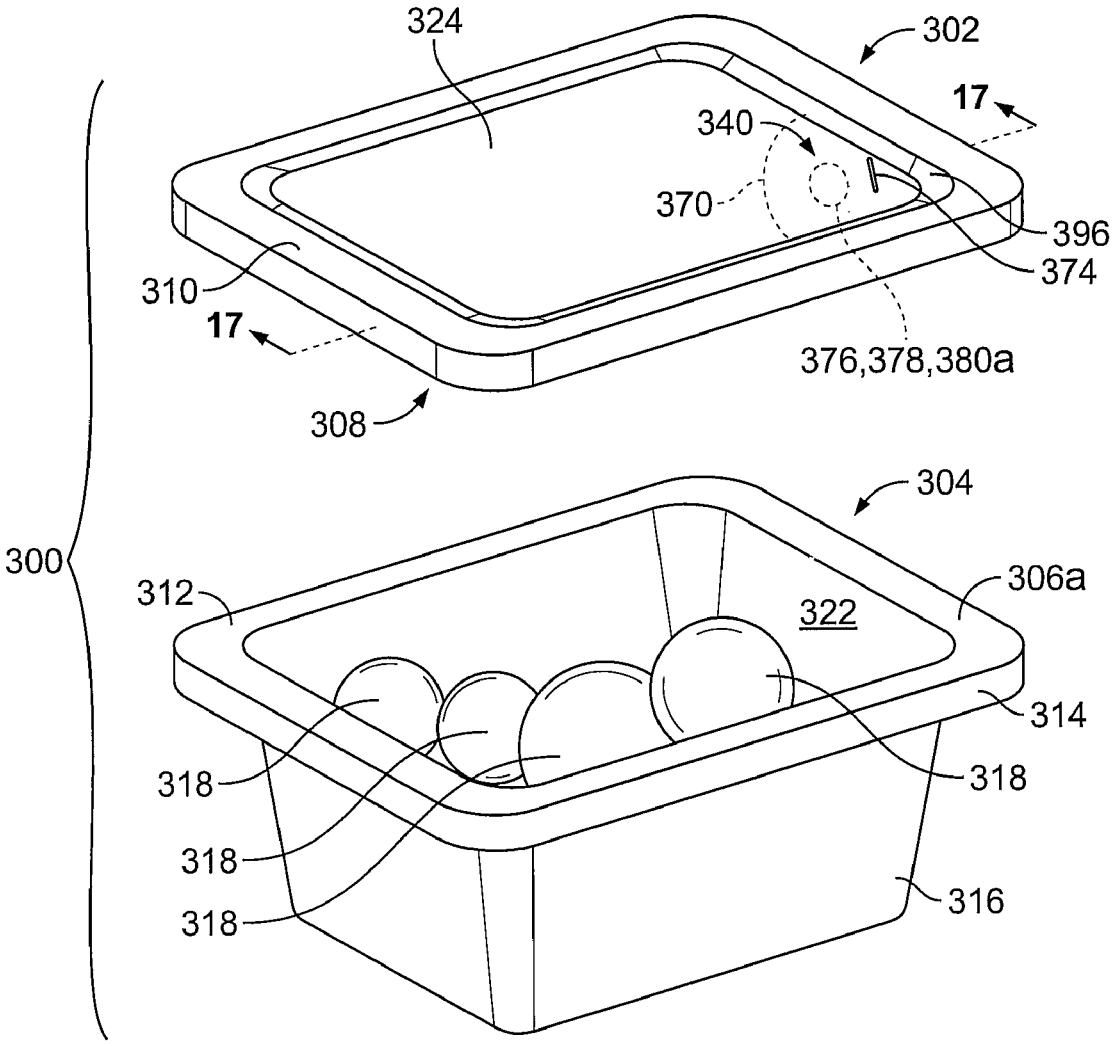
FIG. 16 is an isometric view of another embodiment of a valve on a container.
Figure 17A:
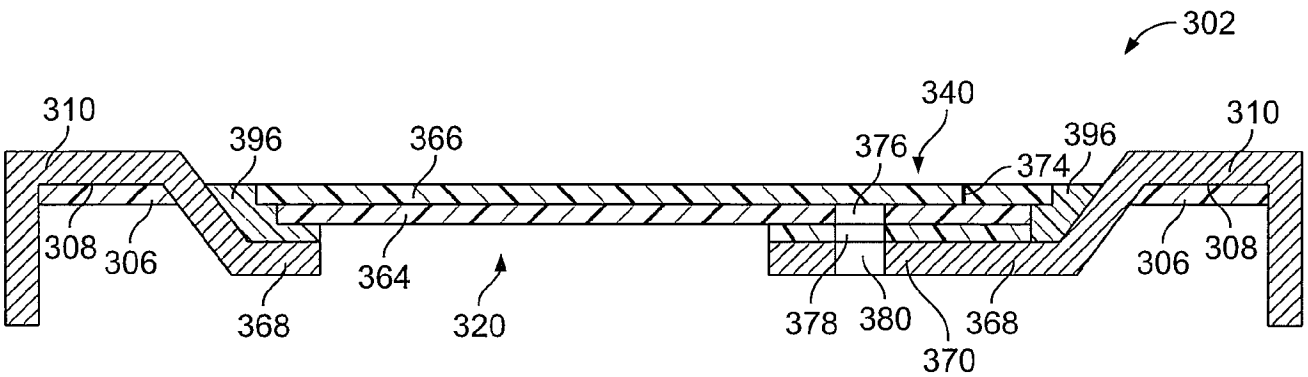
FIG. 17A is a cross-sectional view taken generally along the lines 17-17 of FIG. 16, with portions behind the plane of the cross-section omitted for clarity.

Referring next to FIGS. 16 and 17A, a container 300 having a container lid 302 that includes a valve 340 and that sealingly fits on a hard-walled container body 304 is illustrated. A container useful herein includes those disclosed in, for example, Zettle et al. U.S. Pat. No. 6,032,827 or Stanos et al. U.S. Pat. No. 7,063,231. A sealing layer 306 may be applied to an inner surface 308 of a peripheral rim 310 of the lid 302 to assist in achieving an air-tight seal therebetween. A second sealing layer 306*a* of the same or a different sealing material may also be applied to a surface 312 of a peripheral lip 314 of the container body 304. Any suitable sealing material known to those skilled in the art may be used including, for example, one or more polyolefin plastomers, including, for example, an AFFINITY™ resin manufactured by Dow Plastics. The container body 304 may have rigid sidewalls 316 to support a variety of contents 318, for example, fresh vegetables or other perishable foodstuffs and may be made of any suitable material known to those skilled in the art, including, for example, a thermoplastic resin.

In this embodiment, a first layer 364 is disposed over an opening 320 defined by an inner annular flange 368 of the lid 302. A second layer 366 is also disposed over the opening 320. A first aperture 374 extends through the second layer 366, and a second aperture 376 is offset from the first aperture 374 and extends through the first layer 364. Illustratively, a peripheral thermoplastic weld layer 396 extends partially under the first layer 364 to weld the first and second layers 364 and 366 together and weld the first and second layers to the inwardly projecting annular flange 368. The annular flange 368 has an extension 370 that further extends from the annular flange toward the opening 320. A third aperture 378 extends through the peripheral thermoplastic weld layer 396, and a fourth aperture 380 extends through the flange extension 370. The second, third, and fourth apertures 376, 378, and 380 are aligned along a line perpendicular to the flange extension 370 such that the second aperture 376 is in fluid communication with an interior 322 of the container body 304 when the lid 302 is applied thereto.

Figure 17B:
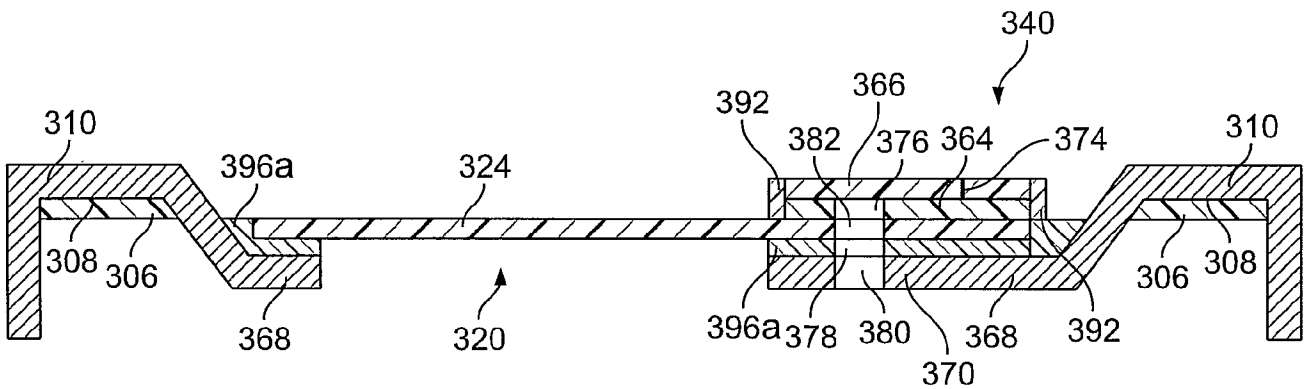
FIG. 17B is a cross-sectional view taken generally along the lines 17-17 of FIG. 16 and illustrating yet another embodiment of a valve, with portions behind the plane of the cross-section omitted for clarity.

Referring to FIG. 17B, another embodiment of the lid 302 is illustrated having an elastomeric film layer 324 that spans the opening 320 defined by the annular flange 368 of the lid 302. The film layer 324 is made of a flexible thermoplastic material, for example, polyolefin plastomer, polypropylene, HDPE, or a blend of any two or all three of polypropylene, HDPE, and polyolefin plastomer. The film layer 324 is attached to the annular flange and the flange extension 370 by any suitable method known in the art, for example, by ultrasonic or thermal welding, by application of an adhesive, or by a thermoplastic weld layer 396*a*.

This embodiment is similar to the embodiment discussed in regard to FIG. 17A except for the differences described in the following. The first layer 364 and the second layer 366 are disposed only over the extent of the flange extension 370. A fifth aperture 382 extends through the film layer 324 and is aligned with the second, third, and fourth apertures 376, 378, and 380 along a line perpendicular to the flange extension 370 such that the second aperture 376 is in fluid communication with the interior 322 of the container body 304 when the lid 302 is applied thereto. The first and second layers 364 and 366 may be applied to the film layer 324 over the flange extension 370 by any suitable method known in the art, for example, by a surrounding seal 392 that surrounds the first and second apertures 374 and 376. The surrounding seal 392 may be a continuous seal or may be an intermittent spot seal as discussed previously for another embodiment herein regarding the surrounding seal 92.

Figure 18:
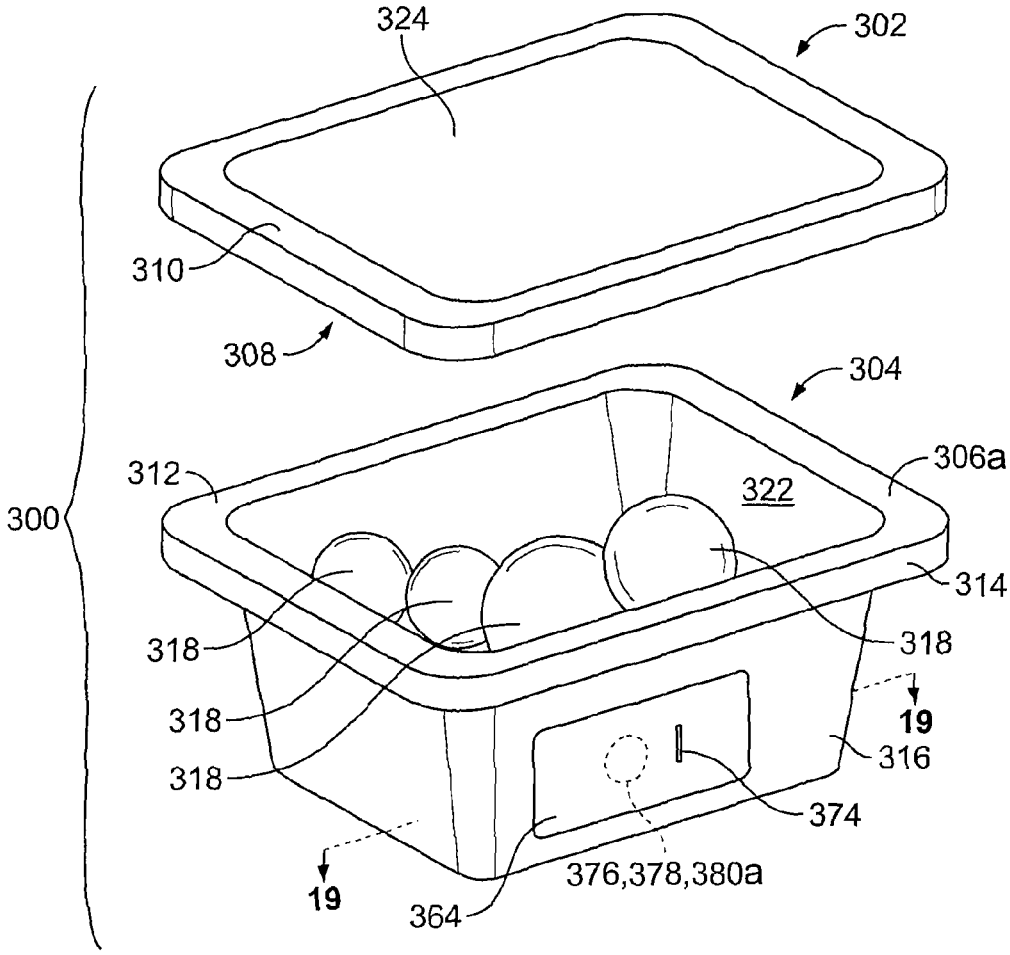
FIG. 18 is an isometric view of a still further embodiment of a valve on a container.
Figure 19:
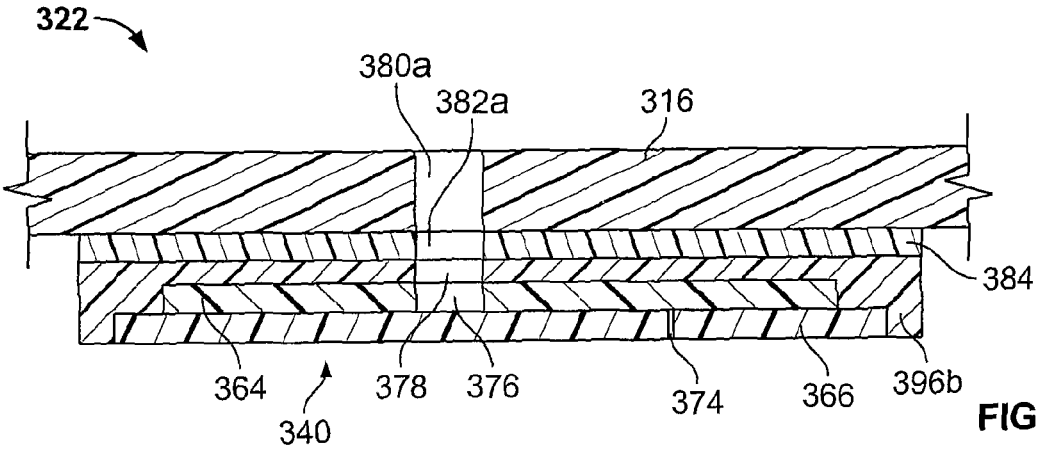
FIG. 19 is a fragmentary cross-sectional view taken generally along the lines 19-19 of FIG. 18, with portions behind the plane of the cross-section omitted for clarity.

Further, it is also contemplated that the valve 340 may be constructed independently of the container 300 and applied to the container, such as to the pouch 50, the container lid 302, or the container body 304, after or during the manufacturing thereof. One such embodiment is illustrated in FIGS. 18 and 19, wherein the valve 340 is applied to the container body 304 using an adhesive layer 384. In this embodiment, the film layer 324 of the lid 302 spans the opening 320 and includes no apertures therethrough. Although the adhesive layer 384 is shown to attach the valve 340 to the container body 304, either of the first and second layers 364 and 366 may be, alternatively or in addition to, attached to the sidewall 316 by any suitable method known in the art, for example, directly by a thermoplastic weld layer 396*b*. The first aperture 374 extends through the second layer 366 and is offset from the second aperture 376 that extends through the first layer 364. The third aperture 378 extends through the thermoplastic weld layer 396*b* and a fourth aperture 380*a* extends through the sidewall 316. A fifth aperture 382*a* extends through the adhesive layer 384. The second, third, fourth, and fifth apertures 376, 378, 380*a*, and 382*a* are aligned along a line perpendicular to the sidewall 316 such that the second aperture 376 is in fluid communication with the interior 322 of the container body 304.

Further, it is believed that the embodiments shown in FIGS. 16-19 operate in a fashion similar to the valves 40 described above. Illustratively, after the contents 318 are placed into the container body 304 and the lid 302 is applied thereto, a source of vacuum pressure (not shown) is applied over the first and second apertures 374 and 376. The flange extension 370 or the sidewall 316 provides a support surface for application of the source of vacuum pressure. As air is removed from the container body 304, the flexible material of the first and second layers 364 and 366 or the film layer 324 are compressed into the container body by atmospheric pressure. The first and second layers 364 and 366 or the film layer 324 cover and conform to the contents 318 as the air is removed from the container body 304. The first and second layers 364 and 366 or the film layer 324 may be attached to the peripheral flange 368 by any suitable method known in the art, for example, by ultrasonic or thermal welding, or by application of an adhesive.

In this, or in any of the embodiments shown, the valve 40 or 340, may be adhered to the pouch 50 or to the container lid 302, film layer 324, or container body 304 as described herein or by an adhesive known to those skilled in the art such as described in Engel et al. U.S. Pat. No. 7,178,555 or Hartman et al. U.S. Patent Application Publication No. 2006/0030472. Further, it is contemplated that a variety of containers are suitable for application of the valves 40 or 340 herein described, including for example, pouches, bowls, bottles, Ziploc® containers, storage boxes, canisters, or other containers, and any lids or covers that may be attachable thereto.

INDUSTRIAL APPLICABILITY

A container is presented that includes a valve to evacuate air from a container. The valve may include first and second layers of film material that form a substantially airtight seal therebetween upon direct contact of the layers. A first aperture through the first layer is offset from a second aperture through the second layer. Vacuum pressure disposed over both of the first and second apertures, for example, causes the first layer to separate from the second layer to allow air to exhaust from the container.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. A reclosable pouch having a valve, comprising:

opposing sidewalls;

first and second opposing layers of a film material disposed across a full width of one of the sidewalls, an overlap region of the second layer overlapping the sidewall, the first layer being attached to the second layer around a portion of the second layer, the second layer being sealed to the sidewall around a periphery of the overlap region, and opposing surfaces of the first and second layers forming a substantially airtight seal therebetween upon direct contact of the layers; and first and second offset apertures extending through the first and second layers, respectively, one of the first and second apertures being in fluid communication with an interior of the pouch and the other of the first and second apertures being in fluid communication with an exterior of the pouch;

wherein vacuum pressure disposed over both of the first and second apertures causes the first layer to separate from the second layer to allow air to exhaust from the pouch.

2. The pouch of claim 1, wherein the overlap region of the second layer comprises the entire second layer.

3. The pouch of claim 2, wherein the entire second layer is sealed to the sidewall.

4. The pouch of claim 3, wherein a first edge of the first layer is attached to the sidewall by a first intermittent spot seal disposed across the full width of the sidewall, and a second edge of the first layer is attached to the sidewall by a second intermittent spot seal disposed across the full width of the sidewall.

5. The pouch of claim 3, wherein first edges of the first and second layers are attached to the sidewall by a first intermittent spot seal disposed across the full width of the sidewall and second edges of the first and second layers are attached to the sidewall by a second intermittent spot seal disposed across the full width of the sidewall.

6. The pouch of claim 2 further comprising:

first and second pluralities of offset apertures extending through the first and second layers, respectively, one of the first and second pluralities of apertures being in fluid communication with the interior of the pouch and the other of the first and second pluralities of apertures being in fluid communication with the exterior of the pouch;

wherein the second layer is sealed to the sidewall around a periphery of the second layer and wherein first edges of the first and second layers are attached to the sidewall across the full width of the sidewall, and second edges of the first and second layers are attached to the sidewall across the full width of the sidewall, and wherein vacuum pressure disposed over apertures of both of the first and second pluralities of apertures causes the first layer to separate from the second layer to allow air to exhaust from the pouch.

7. The pouch of claim 6, wherein the first and second edges are attached to the sidewall by an intermittent spot seal.

8. The pouch of claim 1 further comprising complementary interlocking closure elements disposed on respective opposing sidewalls, and at least one embossed or textured sidewall opposing the first or second aperture that is in fluid communication with the interior of the pouch.

9. A reclosable pouch having a valve, comprising:

opposing sidewalls;

first and second opposing layers of a film material disposed across a full width of one of the sidewalls, the entire second layer overlapping the sidewall, the first layer being attached to the second layer around a portion of the second layer, the entire second layer being sealed to the sidewall by a thermoplastic weld layer disposed across the full width of the sidewall, opposing surfaces of the first and second layers forming a substantially airtight seal therebetween upon direct contact of the layers;

first and second offset apertures extending through the first and second layers, respectively, one of the first and second apertures being in fluid communication with an interior of the pouch and the other of the first and second apertures being in fluid communication with an exterior of the pouch; and a surrounding seal between the first and second layers, the surrounding seal surrounding a region including the first and second offset apertures.

10. The pouch of claim 9, wherein each of the first and second layers independently comprises a first ply of polypropylene or HDPE, and a second ply of polyolefin plastomer, wherein the polyolefin plies are in contact with one another.

11. The pouch of claim 9, wherein one of the first and second layers is a blended film of any two or all three of polyolefin plastomer, polypropylene, and HDPE, and the other of the first and second layers comprises a first ply of polypropylene or HDPE and a second ply of polyolefin plastomer that is in contact with the one of the first and second layers.

12. The pouch of claim 9, wherein each of the first and second layers is an independently blended film of any two or all three of polyolefin plastomer, polypropylene, and HDPE.

13. The pouch of claim 9 further comprising complementary interlocking closure elements disposed on respective opposing sidewalls, and at least one embossed or textured sidewall opposing the first or second aperture that is in fluid communication with the interior of the pouch.

14. A reclosable pouch having a valve, comprising:

opposing sidewalls;

first and second opposing layers of a film material disposed across a full width of one of the sidewalls, an overlap region of the second layer overlapping the sidewall, a region of the second layer that does not overlap the sidewall, the first layer being attached to the second layer around a portion of the second layer, the second layer being sealed to the sidewall around a periphery of the overlap region, and opposing surfaces of the first and second layers forming a substantially airtight seal therebetween upon direct contact of the layers; and first and second offset apertures extending through the first and second layers, respectively, one of the first and second apertures being in fluid communication with an interior of the pouch and the other of the first and second apertures being in fluid communication with an exterior of the pouch;

wherein vacuum pressure disposed over both of the first and second apertures causes the first layer to separate from the second layer to allow air to exhaust from the pouch.

15. The pouch of claim 14 further comprising:

first and second pluralities of offset apertures extending through the first and second layers, respectively, one of the first and second pluralities of apertures being in fluid communication with the interior of the pouch and the other of the first and second pluralities of apertures being in fluid communication with the exterior of the pouch;

wherein first edges of the first and second layers that overlap the sidewall are attached to the sidewall across the full width of the sidewall and second edges of the first and second layers are attached to a closure flange; and wherein vacuum pressure disposed over apertures of both of the first and second pluralities of apertures causes the first layer to separate from the second layer to allow air to exhaust from the pouch.

16. The pouch of claim 15, wherein each of the first and second layers independently comprises a first ply of polypropylene or HDPE, and a second ply of polyolefin plastomer, wherein the polyolefin plies are in contact with one another.

17. The pouch of claim 15, wherein one of the first and second layers is an independently blended film of any two or all three of polyolefin plastomer, polypropylene, and HDPE, and the other of the first and second layers independently comprises a first ply of polypropylene or HDPE and a second ply of polyolefin plastomer that is in contact with the one of the first and second layers.

18. The pouch of claim 17, wherein one of the first and second layers is an independently blended film of about 25% polyolefin plastomer and about 75% of a blend of polypropylene and HDPE, and the other of the first and second layers independently comprises a first ply of polypropylene or HDPE and a second ply of polyolefin plastomer that is in contact with the one of the first and second layers.

19. The pouch of claim 15, wherein each of the first and second layers is an independently blended film of any two or all three of polyolefin plastomer, polypropylene, and HDPE.

20. The pouch of claim 15 further comprising complementary interlocking closure elements disposed on respective opposing sidewalls, and at least one embossed or textured sidewall opposing the first or second aperture that is in fluid communication with the interior of the pouch.

* * * * *